US010359252B2

(12) United States Patent
Ady et al.

(10) Patent No.: US 10,359,252 B2
(45) Date of Patent: Jul. 23, 2019

(54) ARCHERY BOWSTRING ADJUSTER

(71) Applicant: Hoyt Archery, Inc., Salt Lake City, UT (US)

(72) Inventors: Daniel D. Ady, Caldwell, ID (US); Gideon S. Jolley, Syracuse, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 414 days.

(21) Appl. No.: 13/830,524

(22) Filed: Mar. 14, 2013

(65) Prior Publication Data

US 2013/0306046 A1 Nov. 21, 2013

Related U.S. Application Data

(60) Provisional application No. 61/648,900, filed on May 18, 2012.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/1411* (2013.01); *F41B 5/1419* (2013.01)

(58) Field of Classification Search
CPC .. F41B 5/10; F41B 5/123; F41B 5/148; F41B 5/1469; F41B 5/1411; F41B 5/12; F41B 5/1484; F41B 5/1419; F41G 1/467; A63B 2244/04
See application file for complete search history.

(56) References Cited

U.S. PATENT DOCUMENTS 3,065,007 A * 11/1962 Colmer, Jr. ..... F16G 11/12 24/279
3,595,213 A * 7/1971 Storer ..... F41B 5/0094 124/17
4,570,606 A * 2/1986 Peck ..... F41B 5/10 124/25.6
4,656,994 A * 4/1987 Jenks ..... 124/23.1
4,798,100 A * 1/1989 Baumgarten ..... B62L 3/00 188/196 B
4,895,129 A * 1/1990 Hedgpeth ..... 124/87
5,039,138 A * 8/1991 Dickirson ..... F16C 1/101 285/314
5,074,703 A * 12/1991 Dawson ..... G05G 5/12 403/320
5,499,618 A * 3/1996 Thompson ..... 124/25.6
7,669,501 B2 * 3/2010 Rothe ..... F16C 1/226 188/196 B
2007/0193568 A1 * 8/2007 Lee ..... 124/25.6

* cited by examiner

*Primary Examiner* — Melba Bumgarner
*Assistant Examiner* — Amir A Klayman
(74) *Attorney, Agent, or Firm* — Dorsey & Whitney LLP

(57) ABSTRACT

An archery bow adjuster includes first and second adjuster portions. The first portion is configured to mount to one of a bowstring and a cable. The second portion is configured to mount to the one of the bowstring and the cable. The first portion is rotatable relative to the second portion to adjust a length of the one of the bowstring and the cable of an archery bow.

25 Claims, 19 Drawing Sheets

ARCHERY BOWSTRING ADJUSTER

CROSS-REFERENCE TO RELATED APPLICATION

This application claims priority to U.S. Patent Application No. 61/648,900, filed 18 May 2012, and entitled ARCHERY BOWSTRING ADJUSTER, the disclosure of which is incorporated herein in its entirety by this reference.

BACKGROUND

Archery bows typically include a pair of pulleys, with at least one of the pulleys having a cam surface to provide a mechanical advantage while drawing the bow. Archery bows, in particular compound bows, require frequent tuning and upkeep to maintain proper timing of the pulley. The peak draw weight of the archery bow is often something that an archer may want to adjust. The ability to make adjustments to the bow relative to performance, particularly with respect proper bow tuning, is very important for proper and accurate shooting.

Many compound archery bows involve a cam on both ends of the limbs. The timing of when both cams "roll over" is important in maintaining a properly tuned bow. Traditionally it has been difficult to achieve and maintain synchronous roll over of the cams. Even when the archery bow is tuned and the cams roll over at the same time upon initial set up of the archery bow, several potential factors (e.g., string and cable stretch upon shooting the archery bow) may contribute to the cams not rolling over at the same time. The bowstring and cables of a compound archery bow may stretch unequally after a certain number of shots, by excessive heat, or simply the passage of time, thereby causing non-synchronous rollover of the cams. For a compound archery bow to shoot accurately, the cams on a dual cam bow must roll over at the same time to maximize the energy imparted to the arrow on the bowstring. Traditionally, to adjust the cam rollover a compound archery bow must be placed into a bow press (often found only in pro shops) to relax the string and cables so that the string can be adjusted (e.g., by rotating or twisting the bowstring). In addition, string stretch with resulting string rotation may also negatively impact accuracy of single cam systems.

Another aspect relating to proper and accurate shooting relates to the orientation of a peep sight mounted to a bowstring. When properly mounted, the peep sight is aligned precisely with the eye and opening or "peep" window is normal or perpendicular to the archer's line of sight at a full draw condition. As the string stretches through use and over time, the bowstring will rotate. Because the peep sight is typically mounted between strands of the bowstring, as the bowstring stretches, the peep sight rotates with the strings and no longer aligns normal or perpendicular to the archer's line of sight at a full draw condition. Similar to adjustment of the cam rollover, adjusting the orientation of the peep sight commonly requires use of a bow press or other externally attached alignment device, such as rubber tubing.

Accordingly, it would be advantageous to provide improved apparatuses and structures for adjusting bowstrings and cables for archery bows.

SUMMARY

One aspect of the present disclosure relates to an archery bow including a riser, first and second limbs, a bowstring and a bowstring adjuster. The riser includes first and second ends. The first and second limbs extend from respective first and second ends of the riser. The bowstring extends between the first and second limbs. The bowstring adjuster includes a first portion connected to the bowstring at a first location, and a second portion connected to the bowstring at a second location spaced longitudinally from the first location. The second portion is rotatable relative to the first portion to adjust one of a rotation orientation and a length of the bowstring.

The second portion may be rotatable relative to the first portion to adjust a length of the bowstring between the first and second locations. The bowstring may include at least first and second strands, and the first and second portions may extend between the at least first and second strands at the first and second locations, respectively. At least one of the first and second portions may be configured to fix a rotated position of the first portion relative to the second portion.

The bowstring adjuster may include a biasing member configured to bias the first and second portion axially toward each other. The first portion may include a plurality of first teeth and the second portion includes a plurality of second teeth configured to mate with the plurality of first teeth to maintain a rotated position of the second portion relative to the first portion. The bowstring may be inserted through a portion of the bowstring adjuster before connecting the bowstring to the first and second limbs. The bowstring adjuster may further include a peep sight having a peep sight opening. The peep sight may be integrally formed with one of the first portion and the second portion of the bowstring adjuster.

Another aspect of the present disclosure relates to an archery bow that includes a riser, first and second limbs, a bowstring, first and second pulleys, first and second cables, and at least one cable adjuster. The riser has first and second ends. The first and second limbs extend from respective first and second ends of the riser. The bowstring extends between the first and second limbs. The first and second pulleys are carried by the first and second limbs, respectively. The first and second cables are mounted to the first and second pulleys, respectively. The at least one cable adjuster is connected to at least one of the first and second cables and includes first and second portions. The first portion is connected to one of the first and second cables at a first location. The second portion is connected to the one of the first and second cables at a second location spaced longitudinally from the first location. The second portion is rotatable relative to the first portion to adjust a length of the one of the first and second cables.

A separate one of the at least one cable adjuster may be connected to each of the first and second cables. The first portion may include a first connection member configured to be inserted through the one of the first and second cables at the first location, and the second portion may include a second connection member configured to be inserted through the one of the first and second cables at the second location. The at least one cable adjuster may include a biasing member configured to bias the first portion toward the second portion.

Another aspect of the present disclosure relates to an archery bow adjuster that includes first and second adjuster portions. The first portion is configured to mount to one of a bowstring and a cable of an archery bow. The second portion is configured to mount to the one of the bowstring and the cable. The first portion is rotatable relative to the second portion to adjust a length of the one of the bowstring and cable.

The first portion may be biased into contact with the second portion to releasably fix a rotated position of the first portion relative to the second portion. A portion of the first portion may be configured to extend through the one of the bowstring and cable at a first location, and a portion of the second portion may be configured to extend through the one of the bowstring and cable at a second location. The first portion may be rotatable relative to the second portion to adjust a length of the one of the bowstring and cable between the first and second locations. The archery bow adjuster may further include a peep sight connected to one of the first and second portions. One of the first and second portions may include a peep sight having a peep sight opening.

A further aspect of the present disclosure relates to a method of adjusting an archery bowstring. The method includes providing an archery bow having a riser, first and second limbs extending from limb pockets of the riser, a bowstring extending between the first and second limbs, and a bowstring adjuster having at least first and second portions. The method also includes connecting the first portion to the bowstring at a first location, connecting the second portion to the bowstring at a second location axially spaced from the first location, and rotating the first portion relative to the second portion to adjust one of a length of the bowstring and a rotation orientation of the bowstring.

The archery bow may include a peep sight mounted to the bowstring, and rotating the first portion relative to the second portion adjusts a rotated position of the peep sight relative to the riser. The peep sight may be directly connected to one of the first and second portions.

Another aspect of the present disclosure relates to a method of adjusting an archery bow. The method includes providing an archery bow having a riser, first and second limbs extending from limb pockets of the riser, at least one pulley mounted to at least one of the first and second limbs, a bowstring extending between the first and second limbs, at least one cable connected to the at least one pulley, and a cable adjuster having at least first and second portions. The method includes connecting the first portion to the at least one cable at a first location, connecting the second portion to the at least one cable at a second location axially spaced from the first location, and rotating the first portion relative to the second portion to adjust a length of the cable.

The archery bow may include first and second cables connected to first and second pulleys, respectively, and first and second cable adjusters connected to the first and second cables, respectively. Adjusting a length of the cable may adjust timing of rotation of the at least one pulley when operating the archery bow to shoot an arrow.

The foregoing and other features, utilities, and advantages of the subject matter described herein will be apparent from the following more particular description of certain embodiments as illustrated in the accompanying drawings.

DRAWINGS

DETAILED DESCRIPTION

Generally, the present disclosure relates to devices, systems and methods for adjusting at least one of a bowstring and a cable of an archery bow. The adjustment may include at least one of changing tension in or a length of the bowstring and cables, and changing a rotated position of an object attached to the bowstring and cables. Although the terms "bowstring" and "cable" are described as distinct elements in the present disclosure, it is to be understood that the term "bowstring" may mean either a bowstring or a cable for an archery bow.

The adjustments to the bowstring and cables may be performed without having to break down the bow using a relatively small adjustment mechanism, which is directly mounted to the bowstring and cables. The adjustment mechanism may include at least first and second portions that rotate relative to each other. Each of the first and second portions is fixed to the bowstring or cables. Relative rotation of the first and second portions of the adjustment mechanism changes a length of the bowstring or cable between the attachment points of the first and second portions to the bowstring or cables, thereby changing at least one of tension, length, and rotated position of portions of the bowstring or cables.

Figure 9:
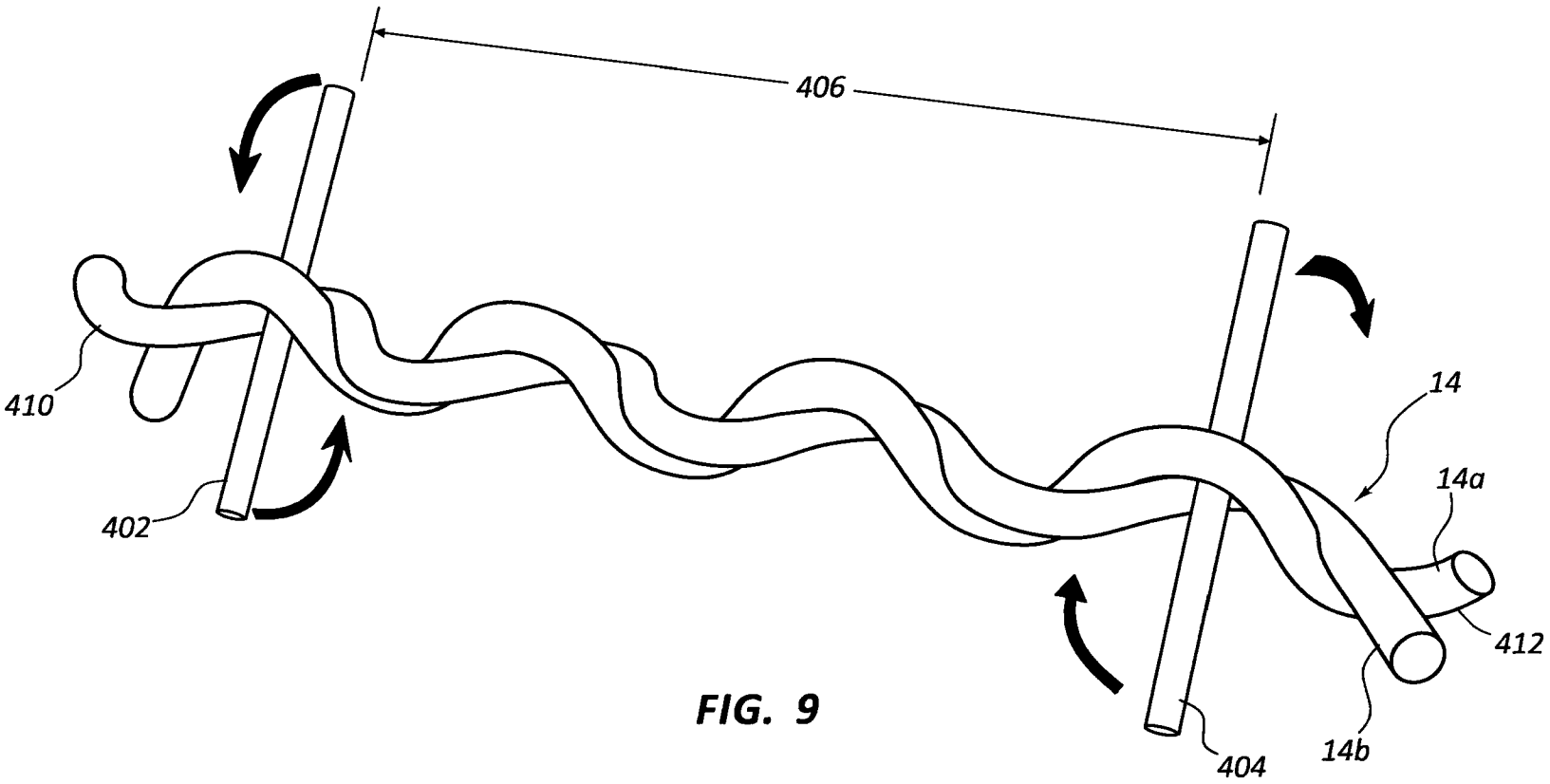
FIG. 9 shows a bowstring and spaced apart rotatable elements used for adjusting the bowstring in accordance with the present disclosure.
Figure 10:
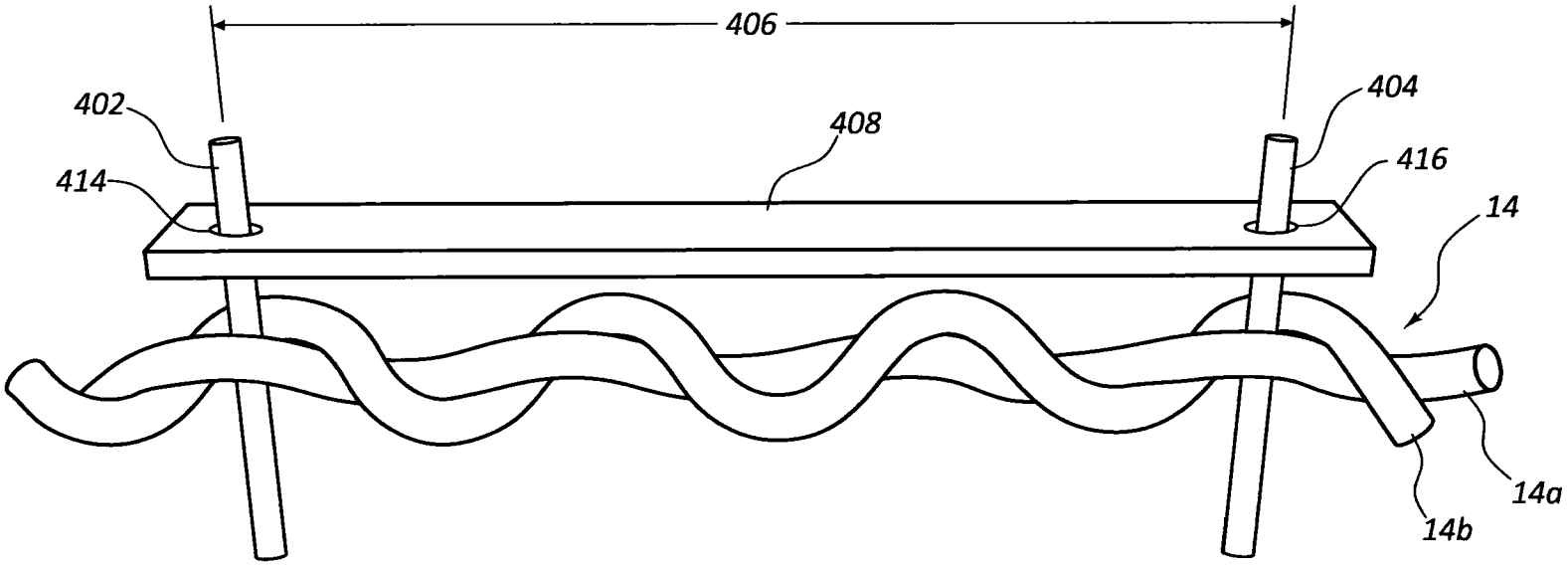
FIG. 10 shows the bowstring and rotatable elements of FIG. 9 fixed with a spacer in accordance with the present disclosure.

General principles related to the adjustment mechanisms disclosed herein are now described with reference to FIGS. 9 and 10. FIGS. 9 and 10 show a bowstring 14 having strands 14*a*, 14*b*. The bowstring 14 may include additional strands. Each of the strands 14*a*, 14*b* may include a plurality of smaller strands. The archery bow cables discussed herein may have the same or similar construction as the bowstring 14 described with reference to FIGS. 9 and 10.

A pair of rotatable elements 402, 404 may be inserted between the strands 14*a*, 14*b* at spaced apart locations along the length of the bowstring 14. The rotatable elements 402, 404 may be spaced apart a separation distance 406. Rotating the rotatable elements 402, 404 in opposite directions relative to each other about a longitudinal axis of the bowstring 14 may change the separation distance 406. Changing the separation distance 406 may change a tension in the bowstring (e.g., either increase or decrease tension). Changing the separation distance 406 may also change a rotated orientation of the bowstring 14.

The twisting of the strands 14*a*, 14*b* may be referred to as a factory twist, since this twisting is applied to the strands of the bowstring 14 (or first and second cables 16, 18 discussed below) are constructed during manufacturing. FIGS. 9 and 10 show the strands 14*a*, 14*b* twisted in a counterclockwise factory twist.

Twisting of the rotatable elements 402, 404 may be determined based on sighting along a longitudinal axis of the bowstring 14. Looking along the bowstring 14 from an end 410 indicates clockwise (CW) or counterclockwise (CCW) direction for rotatable element 402. Looking along the bowstring 14 from an opposite end 412 indicates CW or CCW direction for rotatable element 404. When both rotatable elements 402, 404 are turned counterclockwise, the factory twist of the bowstring 14 is increased, thus shortening the separation distance 406. Similarly, turning rotatable elements 402, 404 in the clockwise direction reduces the factory twist of the bowstring 14, thus increasing a length of the separation distance 406.

Once the desired length and/or tension of the bowstring 14 is achieved (e.g., a separation distance 406), the relative twist between the two rotatable elements 402, 404 may be fixed using a spacer 408 as shown in FIG. 10. The spacer 408 includes holes 414, 416 through which the rotatable elements 402, 404 extend. The spacer 408 limits rotation between the rotatable elements 402, 404. The holes 414, 416 may have various shapes, sizes and orientations to assist in, for example, inserting the rotatable elements 402, 404 and maintaining a rotational orientation of the rotatable elements 402, 404 relative to each other.

In operation, a user of the system of FIGS. 9 and 10 attaches the rotatable elements 402, 404 to the bowstring 14 by inserting the rotatable elements 402, 404 between strands 14*a*, 14*b* at spaced apart locations along the length of the bowstring 14. The user then twists the rotatable elements 402, 404 relative to each other to increase or decrease the factory twist of the bowstring 14, thus shortening or lengthening of the bowstring 14 between the rotatable elements 402, 404. The spacer 408 is used to fix the degree of rotation between the rotatable elements 402, 404.

The rotatable elements 402, 404 preferably are attached to the bowstring 14 by inserting them between strands 14*a*, 14*b* of the bowstring as discussed above. Other methods may be used to connect the rotatable elements 402, 404 to the bowstring 14. For example, adhesives or other bonding agents, crimping, clamping, or other types of mechanical attachment may be used to connect the rotatable elements 402, 404, for example, to an outer surface of the bowstring 14. The spacer 408 may have any desired shape and size. The spacer 408 may be integrated into or pre-assembled with one of the rotatable elements 402, 404. The examples described below with reference to FIGS. 1-8B describe other bowstring and cable adjusters in which the rotatable elements and spacer have different shapes, sizes and configurations that facilitate certain objectives such as, for example, easier mounting to a bowstring or cable, minimizing size and weight, providing easier adjustment, and improving ease of manufacturing.

Figure 1:
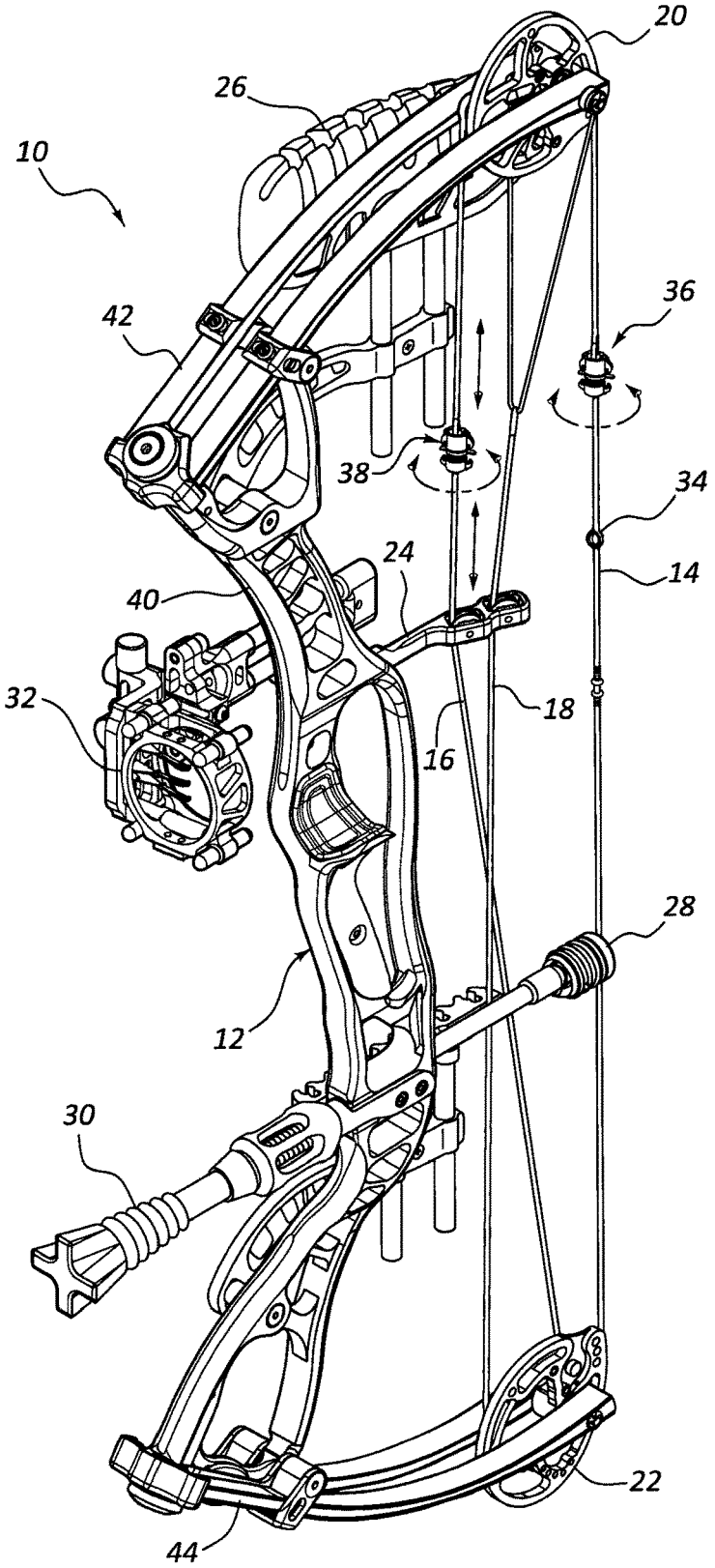
FIG. 1 is a perspective view of an example archery bow having a bowstring adjuster and a cable adjuster in accordance with the present disclosure.

Referring now to FIGS. 2-5, the bowstring adjuster 36 shown in FIG. 1 is described in further detail. The bowstring adjuster 36 includes first and second connector assemblies 50, 52 (also referred to as first and second portions). The first connector assembly 50 includes a first connector 54 and a first insert 56. The second connector assembly 52 includes a second connector 70, a second insert 72, a post 74, a biasing member 76, and a gear 78 (see FIG. 3). The first and second connector assemblies 50, 52 are configured to be releasably assembled together as a single unit or assembly, while maintaining rotatability relative to each other to adjust tension in the bowstring 14.

The first connector 54 includes a bore 58, a pair of receivers 60, and a plurality of gear teeth 62. The bore 58 is receptive of the first insert 56. The first insert 56 includes a spacer portion 64, a string aperture 66, and a plurality of protrusions or latches 68. The spacer portion 64 is sized and configured to extend between strands 14*a*, 14*b* of the bowstring 14. The spacer portion 64 may have contoured surfaces, which interface with the strands 14*a*, 14*b*. The strands 14*a*, 14*b* extend through the string aperture 66. The protrusions 68 are insertable into the receivers 60 to connect the first insert 56 to the first connector 54. The protrusions 68 may provide a fixed rotational position of the first insert 56 relative to the first connector 54. An interface between the protrusion 68 and the receiver 60 may also provide longitudinal fixing of the first insert 56 relative to the first connector 54. The first insert 56 is shown in further detail in FIG. 4.

Figure 5:
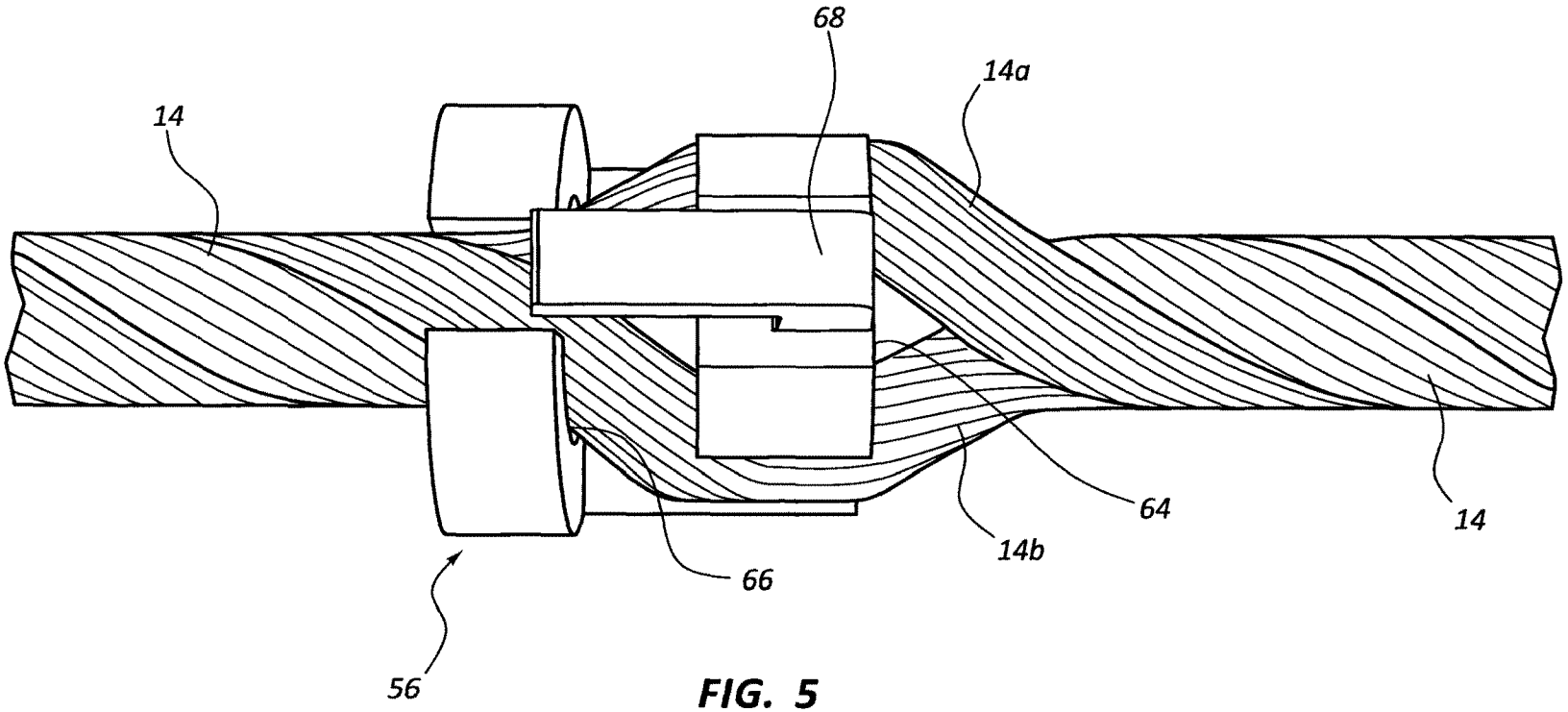
FIG. 5 is a side view of the bowstring adjuster of FIG. 4 mounted to a bowstring.

The first insert 56 may be mounted to the bowstring 14 as shown in FIG. 5. The spacer portion 64 is inserted between the strands 14*a*, 14*b*. The first insert 56 is then inserted into the bore 58 of the first connector 54. The spacer portions 64 are inserted into the receivers 60 to provide a connection between the first connector 54 and the first insert 56.

Referring again to FIG. 3, the second connector 70 includes a bore 80 and a plurality of receivers 82. The second insert 72 includes a spacer 84, a string aperture 86, and a plurality of protrusions 88. The interface between the second connector 70 and second insert 72 may be substantially the same as an interface between the first connector 54 and first insert 56 described above.

Figure 3:
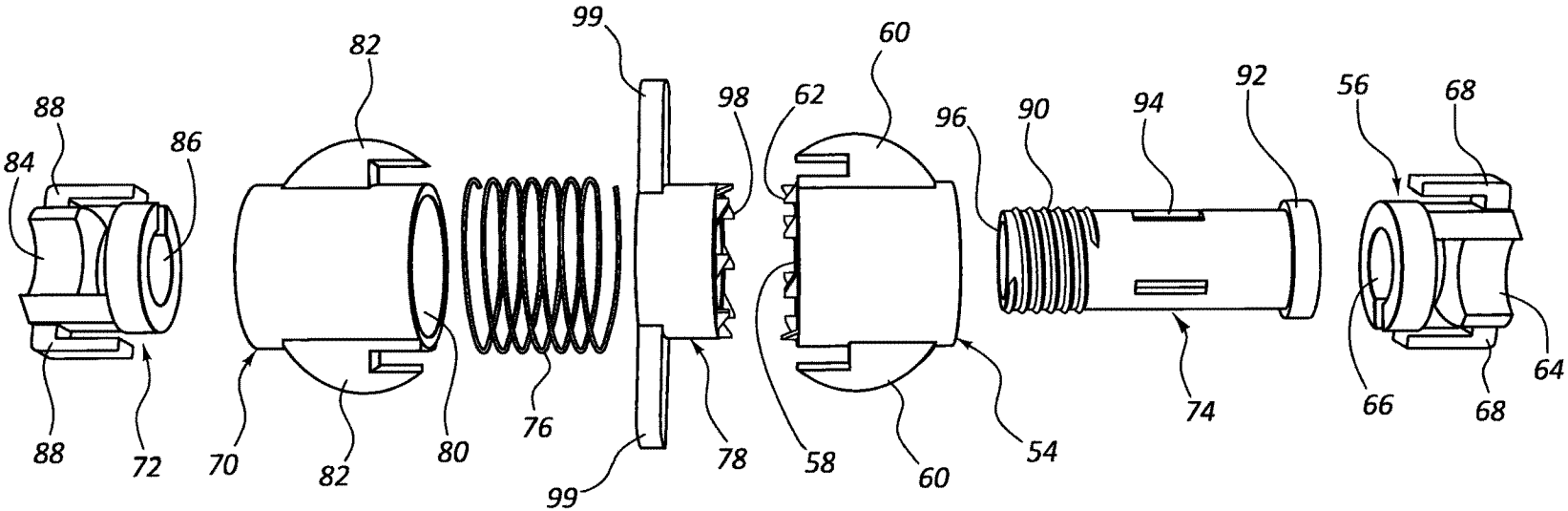
FIG. 3 is an exploded perspective view of the bowstring adjuster of FIG. 2.
Figure 4:
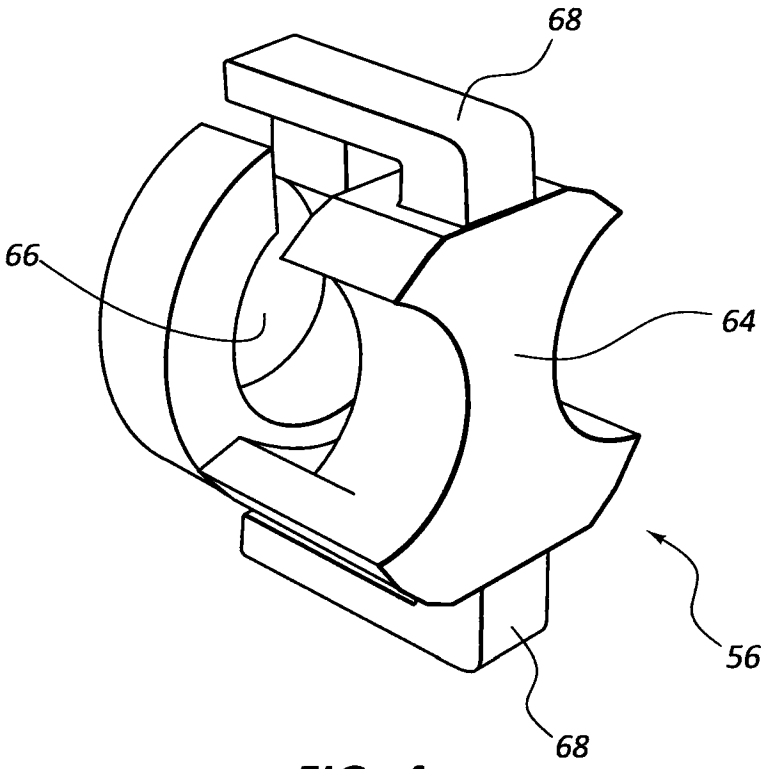
FIG. 4 is a perspective view of an insert of the bowstring adjuster of FIG. 2.

The post 74 includes threads 90, a collar 92, key features 94 and a bore 96 (see FIG. 3.). The threads 90 provide a threaded connection with internal threads formed in the second connector 70. Other attachment features may be used to provide a releasable connection between the post 74 and the second connector 70. The collar 92 may help hold the post 74 within the first connector 54 to secure the first connector assembly 50 to the second connector assembly 52. The key feature 94 may provide an axial track along which the gear 78 travels when moving toward and away from the first connector assembly 50. The key feature 94 transfers rotational forces from the gear 78 to the second connector 70 via the post 74. The gear 78 may include internal grooves configured to receive the key features 94.

The bore 96 and post 74 may be sized to receive the bowstring 14. The post 74 may provide physical separation between the bowstring 14 and the biasing member 76, gear 78, and at least portions of the first and second connectors 54, 70.

The biasing member 76 may be interposed between the second connector 70 and the gear 78. The biasing member 76 may apply biasing force in an axial direction to move the gear 78 toward the first connector 54. The gear 78 may include gear teeth 98 and handles 99. The gear teeth 98 engage the gear teeth 62 of the first connector 54. A user may apply an axial force to the gear 78 via the handles 99 against the biasing forces of biasing member 76 to move the gear teeth 62, 98 out of engagement with each other so that the gear 78 (and second connector 70) may rotate relative to the first connector 54.

The gear 78 may include handles 99 with different shapes, sizes and configurations. The examples described below with reference to FIGS. 6-8B show other example handle arrangements (e.g., a single handle and handle shapes with improved ergonomics).

The bowstring adjuster 36 has a construction that may require connection to a bowstring prior to the bowstring being assembled with an archery bow. The first and second connectors 54, 70 may have a single-piece, tubular construction, which may involve inserting the tubular piece over free ends of the bowstring into a position adjacent to where the first and second inserts 56, 72 are inserted between strands of the bowstring 14. Other constructions may be used for the bowstring adjuster 36 (e.g., those examples described below with reference to FIGS. 6-8B), which may be mounted to the bowstring after the bowstring is assembled with the archery bow.

Figure 2:
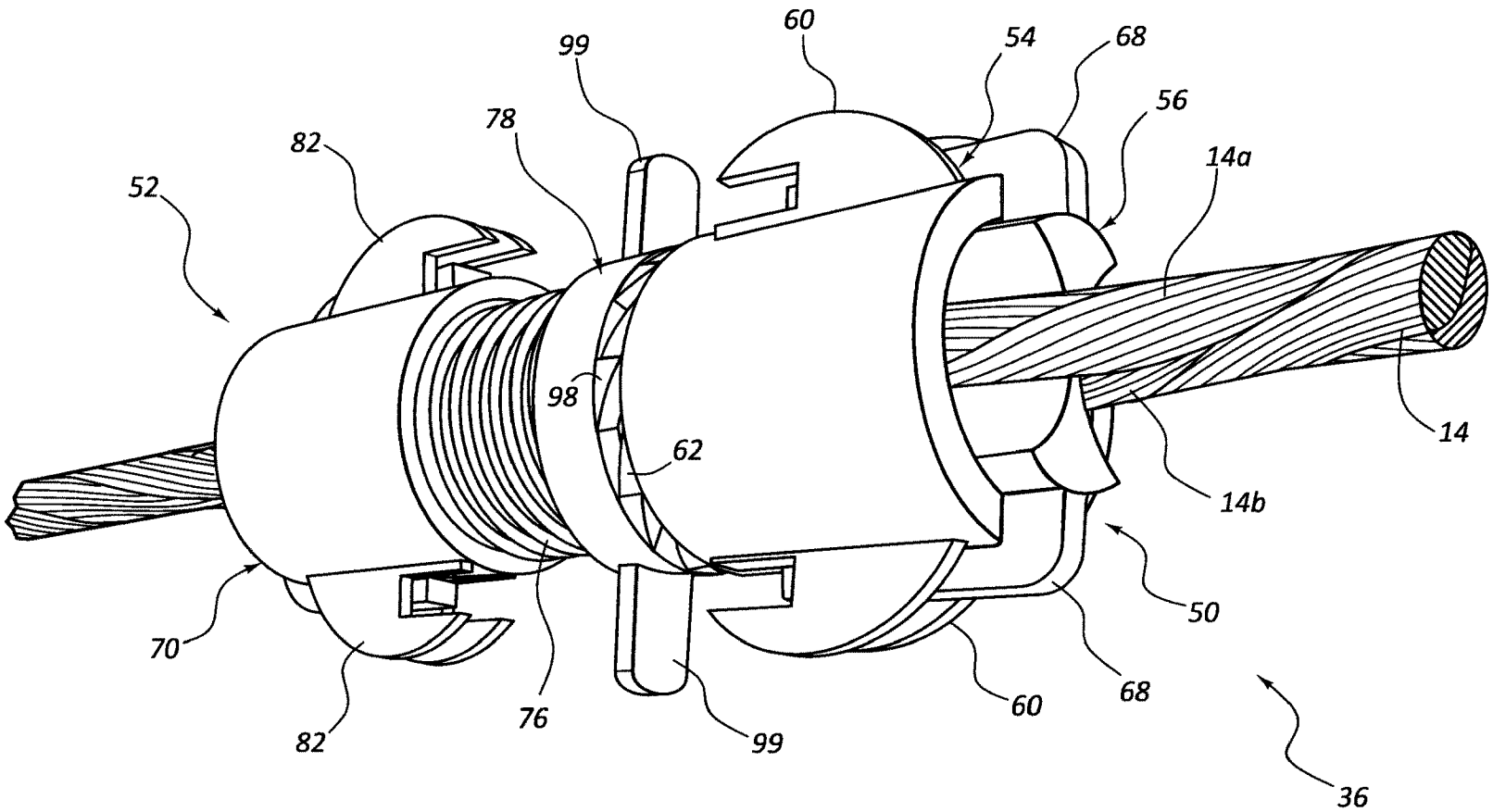
FIG. 2 is a perspective view of the bowstring adjuster of FIG. 1.

The bowstring adjuster 36, after being mounted to bowstring 14 and assembled as shown in FIGS. 1 and 2, may be operated to adjust the length/orientation of the bowstring by first pulling the gear 78 axially away from the first connector 54 to disengage the gear teeth 62, 98. The gear 78, which is connected to the second connector 70 and second insert 72 via the post 74, may then be rotated relative to the first connector assembly 50 to change a length of the bowstring 14 between the first and second connectors 54, 70. Adjusting the length of the bowstring 14 changes a tension in the bowstring, and may also change a rotated position of respective portions of the bowstring. As discussed above, when a peep sight is mounted to the bowstring 14, adjusting the bowstring adjuster 36 may rotate the peep sight relative to the handle assembly 12 and a bow sight 32 mounted to the handle assembly 12. The bowstring adjuster 36 may provide an in-the-field, on-the-go peep sight adjustment quickly and with relative ease, and without the need of using a bow press.

Releasing the gear 78 after making the rotational adjustment relative to the first connector assembly 50 permits the biasing member 76 to move the gear 78 axially towards the first connector assembly 50 to re-engage the gear teeth 62 with the gear teeth 98. The gear 78 fixes a rotational position of the first and second connector assemblies 50, 52 relative to each other.

The cable adjuster 38 operates to adjust an overall length of the cable for purposes of tuning pulley rotation for a compound bow. As discussed above, one purpose of the bowstring adjuster 36 is to rotate the bowstring to align a peep sight with an eye of the archer when the archery bow is a full draw. The cable adjuster 38 may have the same or similar construction and function as the bowstring adjuster 36. In other arrangements, the cable adjuster 38 may include different features as compared to the bowstring adjuster 36 such as, for example, attachment features for fixing the cable adjuster to the cable or mounting the cable adjuster to the cable after assembly of the bow.

A separate cable adjuster 38 may be positioned on each of the first and second cables 16, 18. The cable adjuster 38 may be positioned at any location along a length of either one of the first and second cables 16, 18. Furthermore, a plurality of cable adjusters 38 may be positioned on any one of the first and second cables 16, 18. A plurality of bowstring adjusters 36 may be positioned along the length of the bowstring 14.

Figure 6:
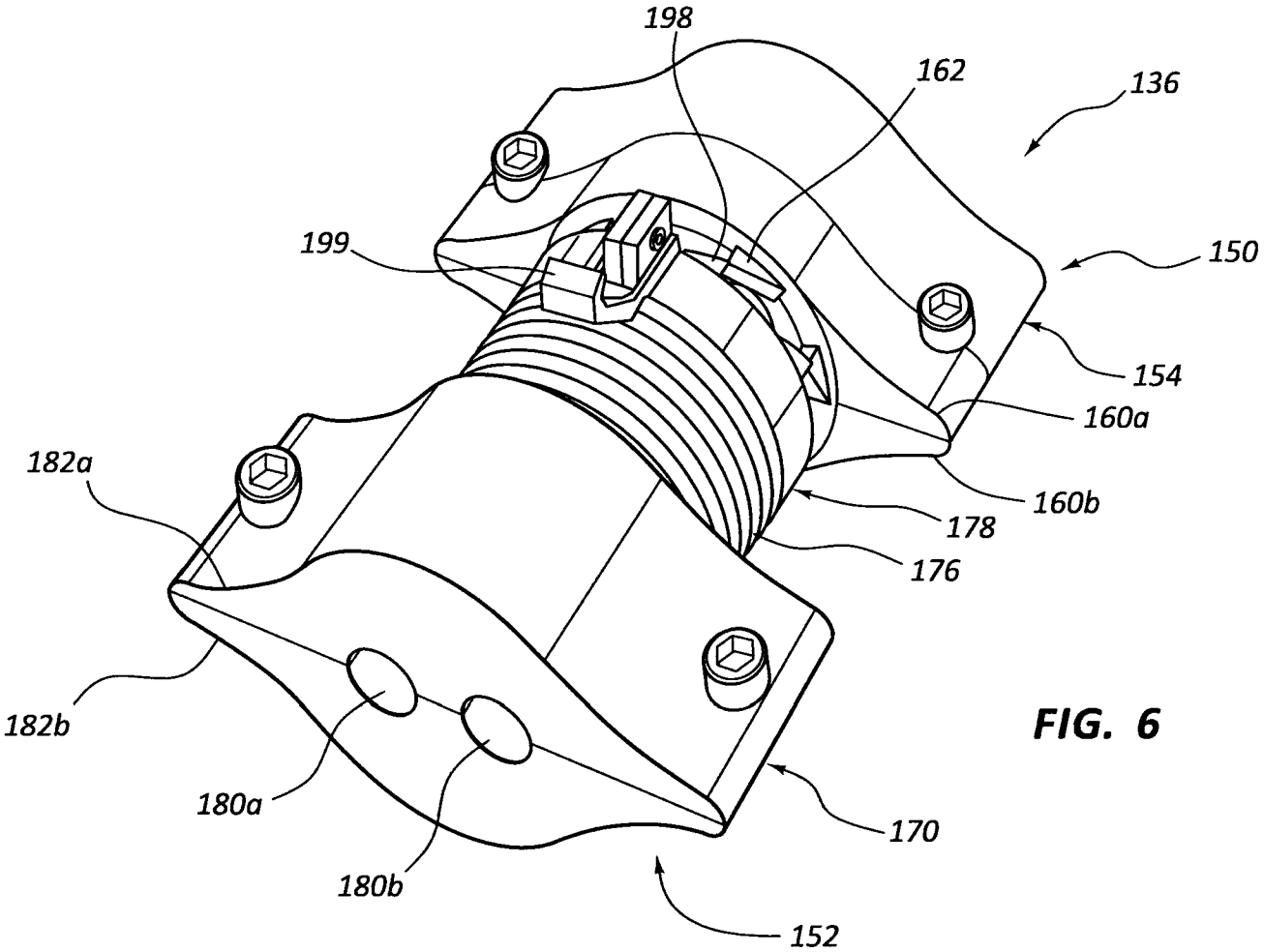
FIG. 6 is a perspective view of another example bowstring adjuster in accordance with the present disclosure.

Referring now to FIG. 6, another example bowstring adjuster 136 is shown and described. The bowstring adjuster 136 may include at least some of the features of the first and second inserts 56, 72 integrated into the first and second connectors. The bowstring adjuster 136 may include a first connector assembly 150 and a second connector assembly 152. The first connector assembly 150 may include a first connector 154 having first and second housing members 160*a*, 160*b* and a plurality of teeth 162. The first and second housing members 160*a*, 160*b* may provide a clamping function to secure the first connector assembly 150 to a bowstring or at least some strands of a bowstring.

The second connector assembly 152 includes a second connector 170, a biasing member 176, and a gear 178. The second connector 170 includes first and second bores 180*a*, 180*b* and first and second housing members 182*a*, 182*b*. The first and second housing members 182*a*, 182*b* may mount to the bowstring with strands of the bowstring extending through the first and second bores 180*a*, 180*b* to fix the second connector 170 to the bowstring. Fasteners may be used to tightly secure the second connector to the bowstring. The gear 178 includes teeth 198 and handles 199. The biasing member 176 biases the teeth 198 into engagement with the teeth 162 to fix relative rotation between the first and second connector assemblies 150, 152. The gear 178 is coupled to the second connector 170 so that rotation of the gear 178 provides rotation of the second connector 170.

The bowstring adjuster 136 may be operated to alter or adjust a length, change tension within, or alter a position or orientation of a bowstring, either at rest or at full draw. The bowstring adjustment may be effected by first grasping the handles 199 and pulling the gear 178 away from the first connector 154. The first connector 154 may then be rotated relative to the second connector 170. Thereafter, the user may release the pressure on the handles 199 so that the biasing member 176 can move the gear 178 axially to re-engage the teeth 198 with the teeth 162.

The bowstring adjuster 136 may include a plurality of fasteners that help secure the first and second housing members 160*a*, 160*b* and 182*a*, 182*b* together for purposes of mounting the bowstring adjuster 136, or at least portions thereof, to the bowstring after the bowstring has been assembled with an archery bow. Some portions of the bowstring adjuster 136 may be inserted onto the bowstring prior to assembling the bowstring with the archery bow. In one example, the gear 178 is provided in two separate halves, which are secured together about a bowstring that has been pre-assembled with the archery bow. The biasing member 176 may be mounted to the bowstring after the bowstring is assembled with an archery bow by feeding the bowstring between coils of the biasing member 176.

The bowstring adjuster 136 may include separate insert members, which are first secured to the bowstring and later inserted into the first and second connectors 154, 170. Alternatively, separate connection features such as those described with reference to FIG. 7 may be inserted through the bowstring (or between strands of the bowstring) and then connected to the first and second connectors 154, 170 to securely fix the bowstring adjuster 136 to the bowstring.

Figure 7:
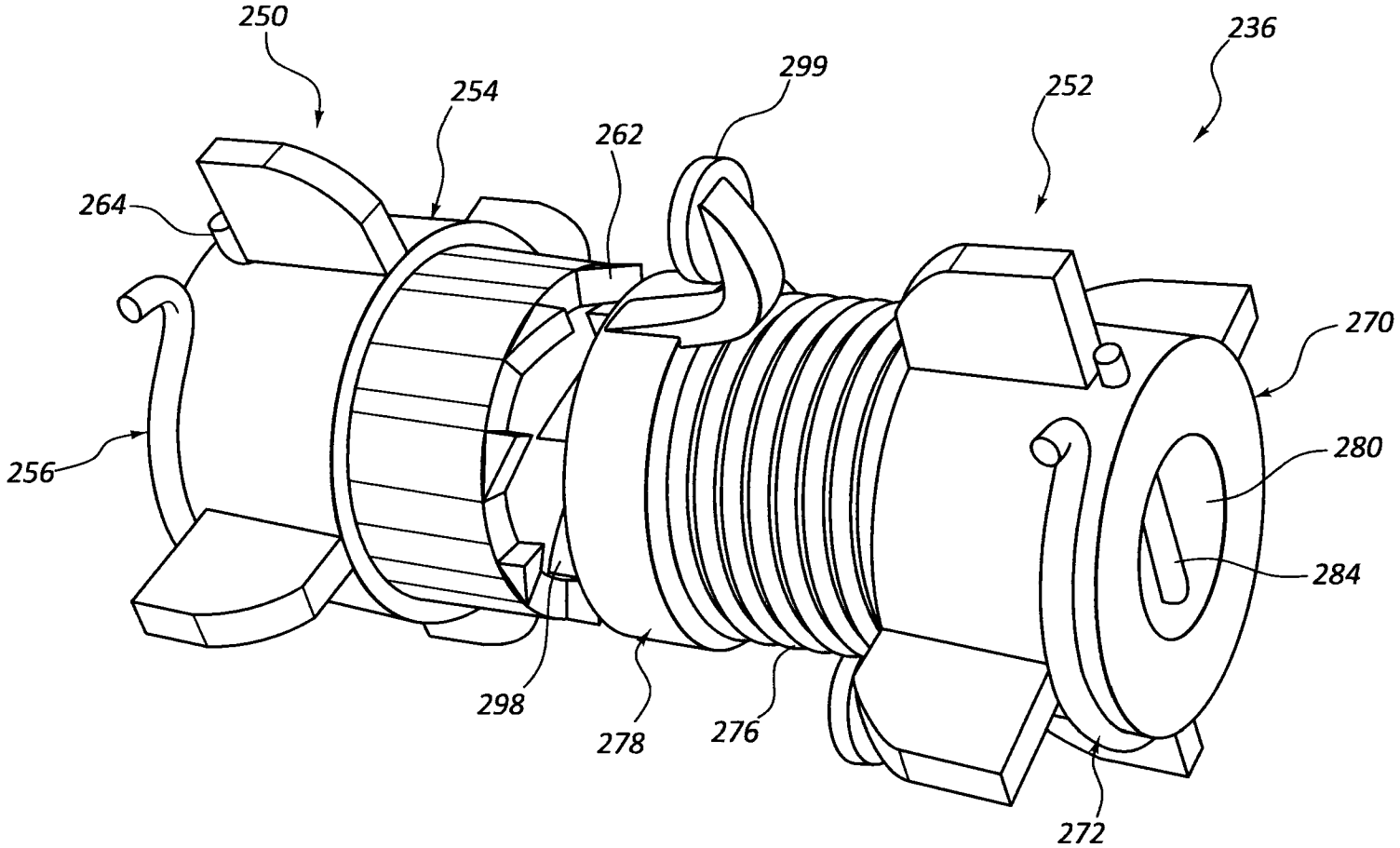
FIG. 7 is a perspective view of another example bowstring adjuster in accordance with the present disclosure.

Referring now to FIG. 7, another example bowstring adjuster 236 is shown including first and second connector assemblies 250, 252. The first connector assembly 250 includes a first connector 254 and a first insert 256. The first connector 254 includes a plurality of teeth 262. The first insert 256 includes a spacer 264. The second connector assembly 252 includes a second connector 270 and a second insert 272. The second connector 270 includes a bore 280 and the second insert 272 includes a spacer 284. The second connector assembly 252 further includes a biasing member 276 and a gear 278 having a plurality of teeth 298 and handle 299.

The first and second inserts 256, 272 may have a clip construction with a first portion of the clip configured to extend laterally through the bore of an associated connector (e.g., bore 280) and another portion of the clip extending around a portion of an exterior of the associated connector to provide a positive connection between the insert and the connector. The first and second inserts 256, 272 may provide a releasable connection of the bowstring adjuster 236 to a bowstring. The first and second inserts 256, 272 may extend between strands of the bowstring 14 to secure the first and second connectors 254, 270 to the bowstring 14 at axially spaced apart locations.

Once the bowstring adjuster 236 is assembled as shown in FIG. 7 and mounted to a bowstring as discussed above, the bowstring adjuster 236 operates in a similar manner to the bowstring adjusters 36, 136 described above. A user may apply an axially directed force to the handle 299 of the gear 278 to move the gear 278 axially away from the first connector 254 and disengage the teeth 262, 298. The user may then rotate the gear 278 and the second connector 270 (e.g., via a connection therebetween) to provide relative rotation between the first and second connector assemblies 250, 252. This relative rotation may change a length of the bowstring between the first and second inserts 256, 272, thereby changing a tension or a rotated position of the bowstring. The user may lock the relative rotated position between the first and second connector assemblies 250, 252 by releasing the handle 299 so that the teeth 262, 298 re-engage.

Figure 8A:
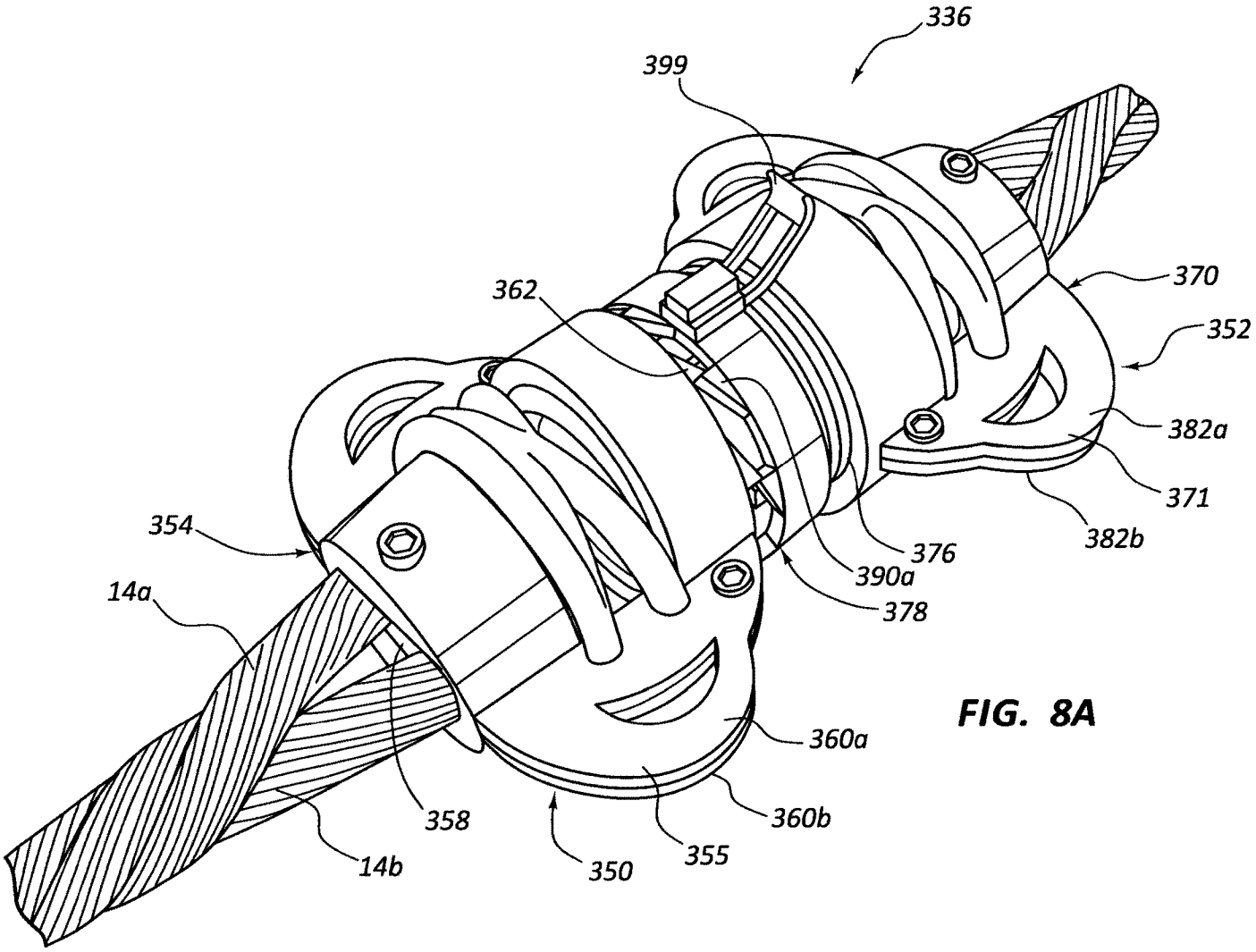
FIGS. 8A and 8B show another example bowstring adjuster in accordance with the present disclosure.
Figure 8B:
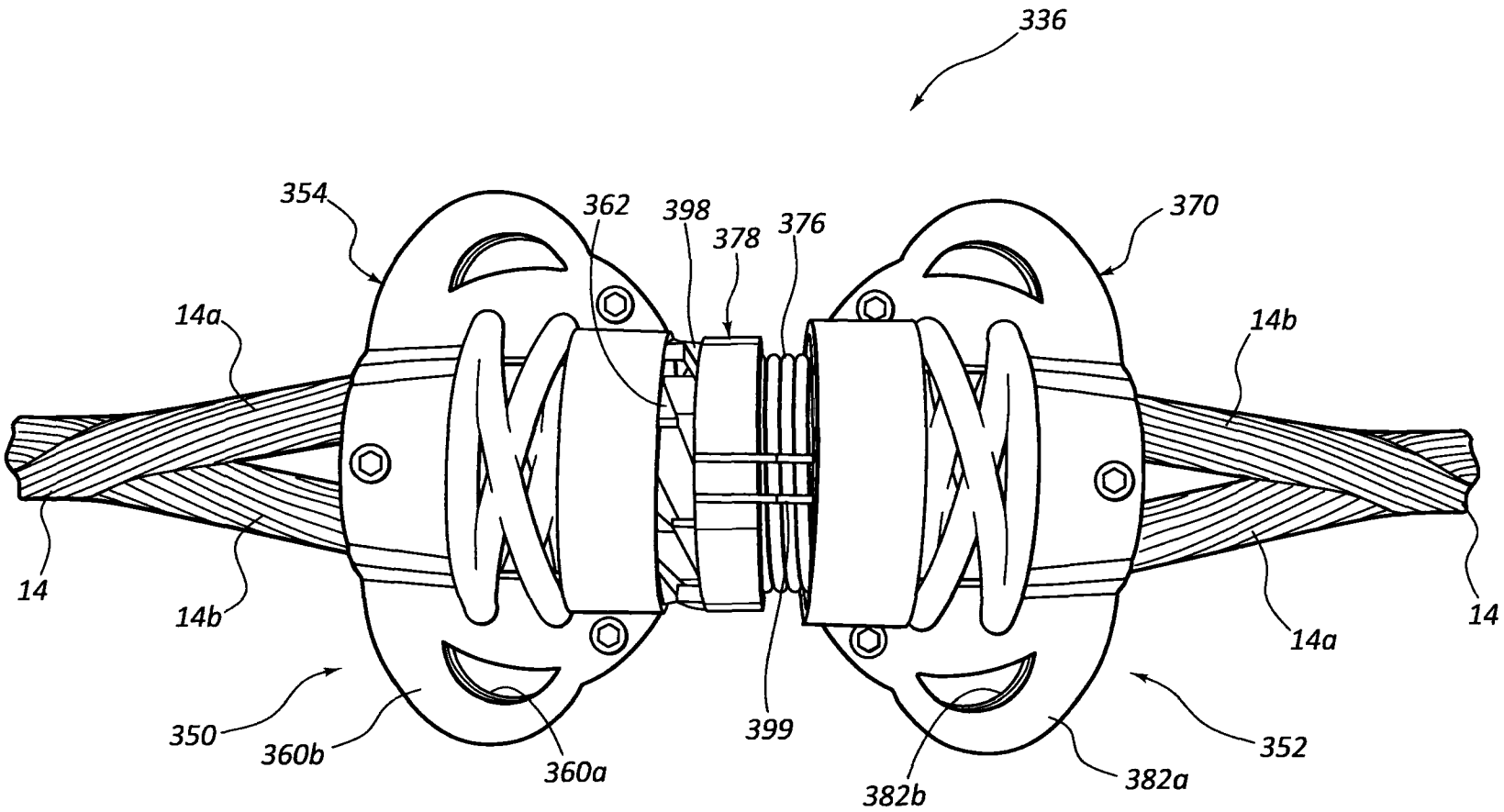

FIGS. 8A and 8B show another example bowstring adjuster 336 including first and second connector assemblies 350, 352. The first connector assembly 350 includes a first connector 354 having a bore 358, first and second housing members 360*a*, 360*b*, and a plurality of gear teeth 362. The second connection assembly 352 includes a second connector 370, a biasing member 376, and a gear 378. The second connector 370 includes first and second housing members 382*a*, 382*b*. The gear 378 includes a plurality of teeth 398 and at least one handle 399.

The first and second housing members 360*a*, 360*b* and 382*a*, 382*b* may be releasably secured together using, for example, a fastener. The first and second connectors 354, 370 may be mounted to a bowstring after the bowstring has been assembled with an archery bow. Alternatively, the first and second connectors 354, 370 may be pre-assembled and inserted over a bowstring into a desired position prior to assembling the bowstring with an archery bow. Securing first and second housing members of the first and second connectors together may concurrently fix the connectors to the bowstring. A portion of the first and second connectors may extend between strands of a bowstring to provide a positive connection with the bowstring. The first and second connectors may apply a clamping force to an exterior of the bowstring that provides the desired positive connection.

The biasing member 376 may bias the teeth 398 of gear 378 into engagement with the teeth 362 of the first connector 354. The user may apply an axially directed force to the handle 399 to move the gear 378 away from the first connector 354 to disengage the teeth 398 from the teeth 362. Thereafter, the first and second connector assemblies 350, 352 may rotate relative to each other to change a length of the bowstring between the first and second connectors 354, 370 to adjust or alter tension in, change a length of the bowstring, or adjust a rotated position of the bowstring. Releasing the applied force to handle 399 permits the biasing member 376 to move the gear 378 axially to re-engage the teeth 398 with the teeth 362 to fix the rotated position of the first and second connector assemblies 350, 352 relative to each other.

At least some features of the bowstring adjuster and cable adjuster disclosed herein may provide surfaces specifically designed for easier application of torque to the first and second connection assemblies. For example, the first and second connectors 354, 370 shown in FIGS. 8A and 8B include wing or handle features 355, 371, which the user may use to apply rotational forces to as part of operating the adjuster. In some arrangements, the gear of the adjuster may include features that promote easier application of a rotation force (e.g., torque) to adjust the rotated position of portions of the adjuster.

The features and functions of the string adjuster embodiments described above with reference to FIGS. 1-8B may be implemented into a cable adjuster, which is mounted to at least one of the first and second cables 16, 18 of archery bow 10. The example bowstring adjusters and cable adjusters disclosed herein may be configured for mounting to a bowstring/cable after the bowstring/cable has been assembled with an archery bow. Alternatively, at least some of the features of the bowstring adjuster and cable adjuster may be pre-mounted to the bowstring/cable while other features thereof may be mounted to the bowstring/cable after assembly with the archery bow. In still further arrangements, all of the features of the bowstring and cable adjusters are pre-mounted to the bowstring/cable prior to assembly of the bowstring/cable to the archery bow.

Figure 19:
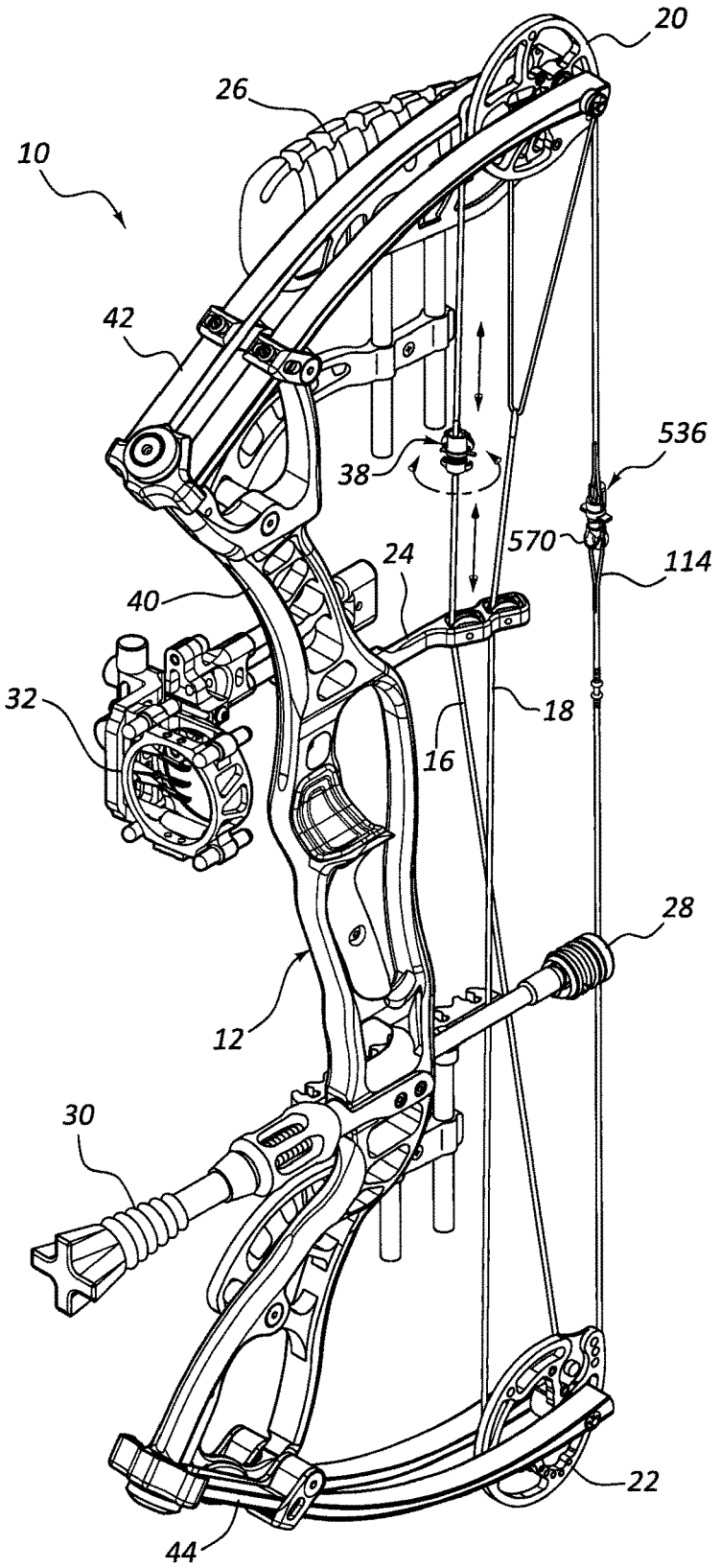
FIGS. 19 and 20 show the bowstring adjuster of FIG. 11 connected to an archery bow.
Figure 20:
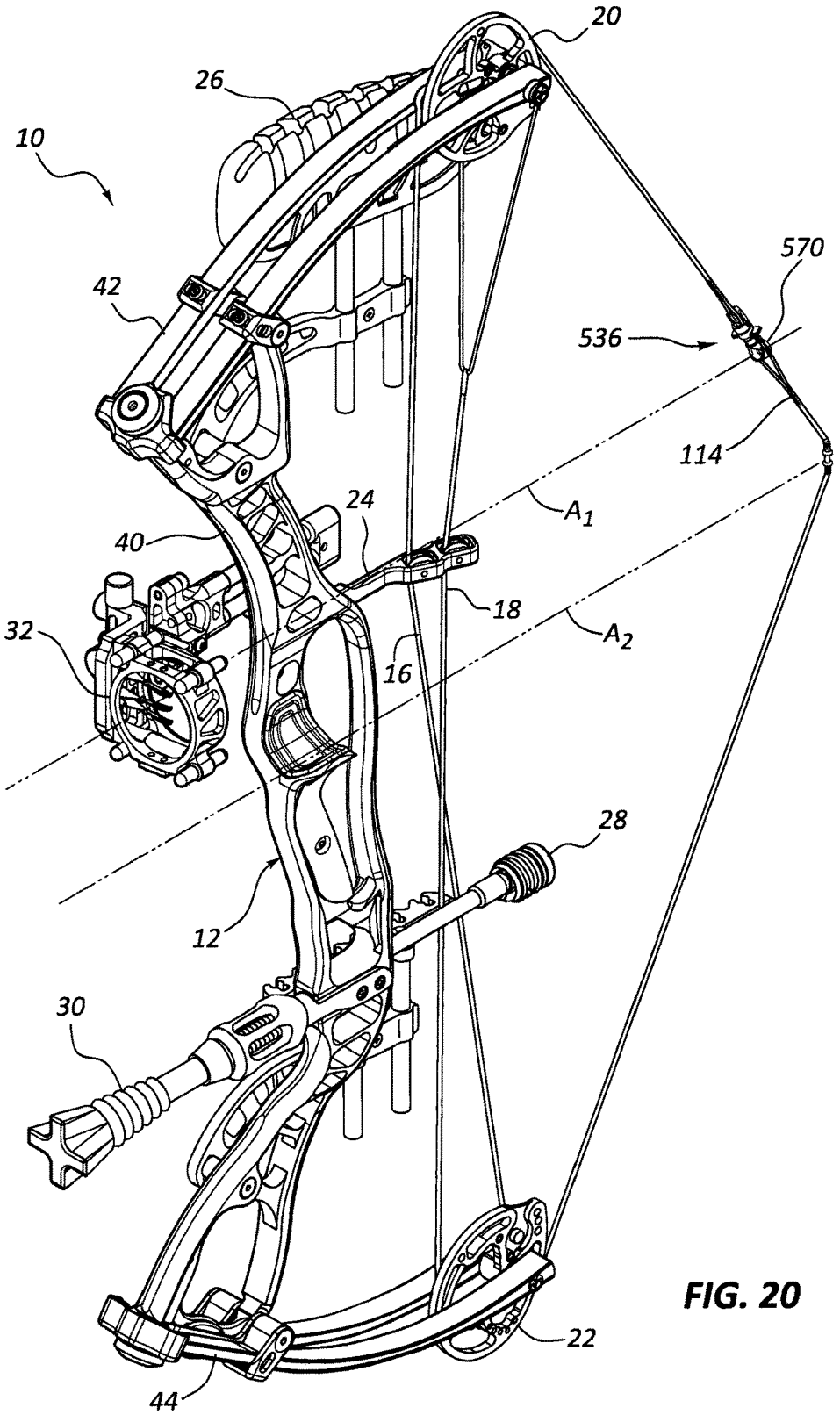

FIGS. 11-18 show another example bowstring adjuster 536. The bowstring adjuster 536 may include an integral peep sight. The bowstring adjuster 536 is shown in FIGS. 19 and 20 mounted to and in use with the archery bow 10.

The bowstring adjuster 536 includes first and second connection assemblies 550, 552. A gear member 578 is interposed between the first and second connection assembly 550, 552. A peep sight element or feature is included in one of the first and second connection assemblies 550, 552. In the illustrated example, the second connection assembly 552 includes a peep sight portion 570 positioned at an end thereof opposite a position of the first connection assembly 550. As shown in at least FIG. 17, the peep sight portion 570 may be integrally formed as a single or unitary piece with the remaining portions of the second connection assembly 552.

Generally, the bowstring adjuster 536 may include a fewer number of parts than the bowstring adjusters 36, 136, 236, 336 described above with reference to FIGS. 1-10. The reduced number of parts in the bowstring adjuster 536 may have advantages related to, for example, easier and/or reduced complexity in assembly and manufacture of the bowstring adjuster 536.

The first connection assembly 550 includes a bore 558, a plurality of teeth 562, a spacer 564, and a seat or stop surface 566. The spacer 564 is insertable between strands 14*a*, 14*b* of a bowstring 14. The strands 14*a*, 14*b* extend through the bore 558. The teeth 562 interface with teeth features of the gear member 578, as will be described below. The seat 566 may assist in maintaining assembly of the first and second connection assemblies 550, 552. The seat 566 may limit movement of the first and second connection assemblies 550, 552 in axial direction relative to each other. The seat 566 may include a protrusion or ring feature that extends radially inwardly into contact with the second connection assembly 552.

The first connection assembly 550 has a generally open construction in an area around the spacer 564. The spacer may include grooves 565 on opposing sides thereof within which the strands 14*a*, 14*b* of the bowstring 14 are retained (see FIGS. 11 and 15). The strands 14*a*, 14*b* may be moved out of the grooves 565 to remove the spacer 564 from between the strands 14*a*, 14*b*.

The second connection assembly 552 includes a post portion 574 and a peep sight portion 570. The post portion 574 and peep sight portion 570 may be integrally formed as a single piece. In other arrangements, the post portion 574 and peep sight portion 570 may be formed as separate pieces that are secured or otherwise assembled together in a separate assembly step.

The post portion 574 may include a slot 594, a connection portion 595, and a bore 596. The bowstring strands 14*a*, 14*b* may extend laterally through the slot 594 and into the bore 596. The strands 14*a*, 14*b* may extend along an exterior surface of the peep sight portion 570, such as along and within string grooves 573 of the peep sight portion 570 (see FIGS. 11, 12). The peep sight portion 570 may also include a peep sight opening 572. The peep sight opening 572 may be positioned between the strands 14*a*, 14*b*. The peep sight opening 572 may have a central axis $A_1$ (see FIG. 17).

Figure 17:
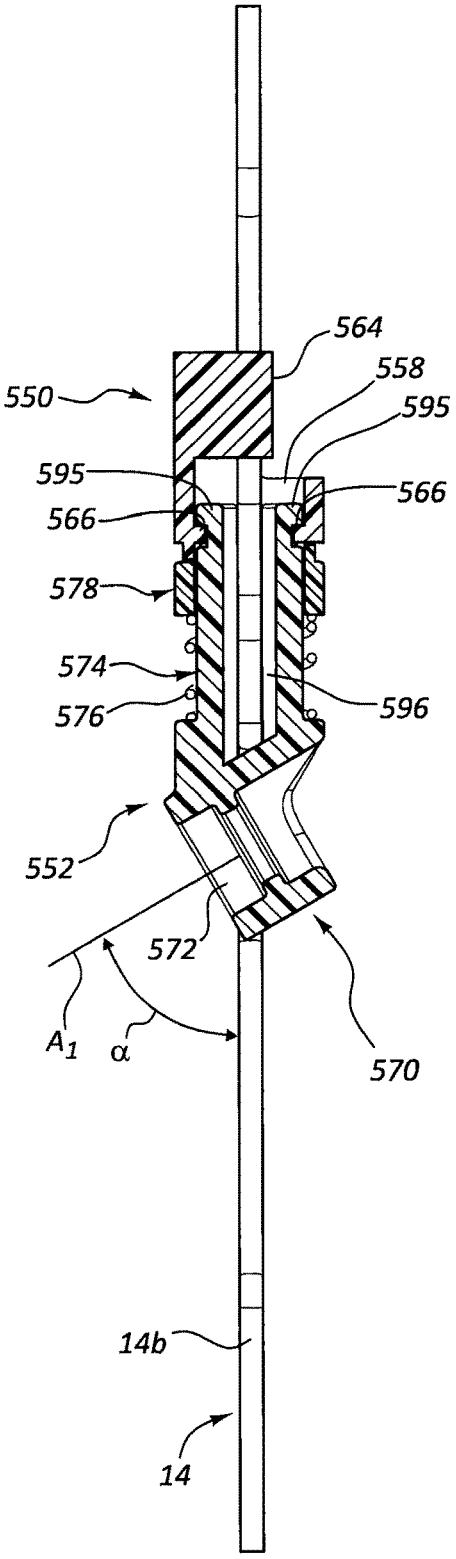
FIG. 17 is a cross-sectional view of the bowstring adjuster of FIG. 13 taken along cross-section indicators 17-17.
Figure 18:
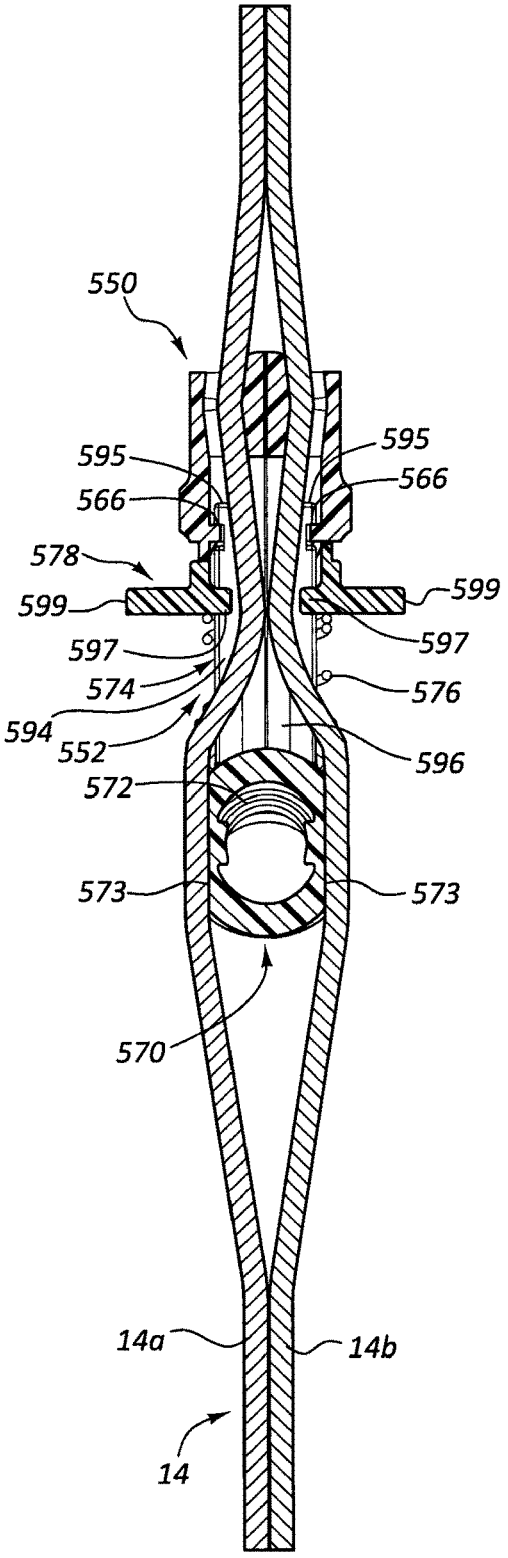
FIG. 18 is a cross-sectional view of the bowstring adjuster of FIG. 14 taken along cross-section indicators 18-18.

The post portion 574 may extend through the bore 558 of the first connection assembly 550 as shown in FIGS. 17 and 18. The connection portion 595 may contact the seat 566 to retain the first and second connection assemblies 550, 552 assembled together. In at least one example, an end of the post portion 574 adjacent to the connection portion 595 may be insertable into the bore 558 until the connection portion 595 connects with the seat 566. In one example, the connection portion 595 includes a groove formed in an outer circumferential surface of the post portion 574. An interface between the connection portion 595 and the seat 566 may permit relative rotation between the first and second connection assemblies 550, 552 while limiting axial movement between the first and second connection assemblies 550, 552.

A gear member 578 may be interposed between the first and second connection assemblies 550, 552. The gear member 578 may include at least one follower 597, a plurality of teeth 598, and at least one handle 599. The followers 597 may extend through the slots 594 of the post portion 574 as shown in FIG. 18. The follower 597 may be positioned within the slots 594, which allows for axial movement of the gear member 578 along a length of the post portion 574 while limiting rotational movement of the gear member 578 relative to the post portion 574.

A biasing member 576 may be mounted to the first connection assembly 550 such as along an exterior of the post portion 574. Biasing member 576 may bias the gear member 578 toward the first connection assembly 550 to engage the teeth 598 with the teeth 562 of the first connection assembly 550.

Figure 11:
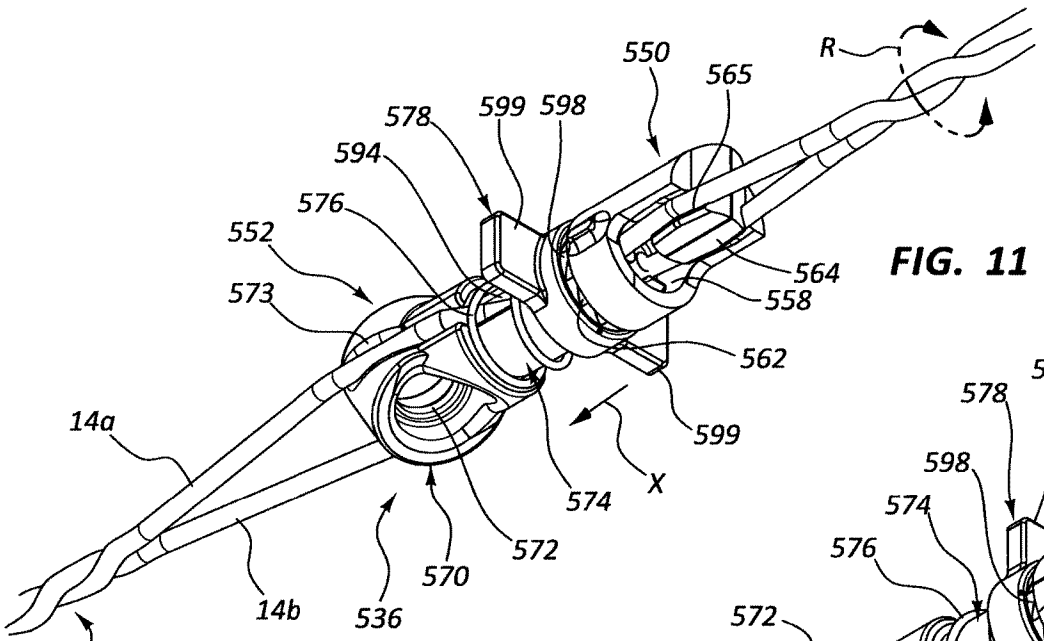
FIGS. 11 and 12 are perspective views of another example bowstring adjuster in accordance with the present disclosure.
Figure 12:
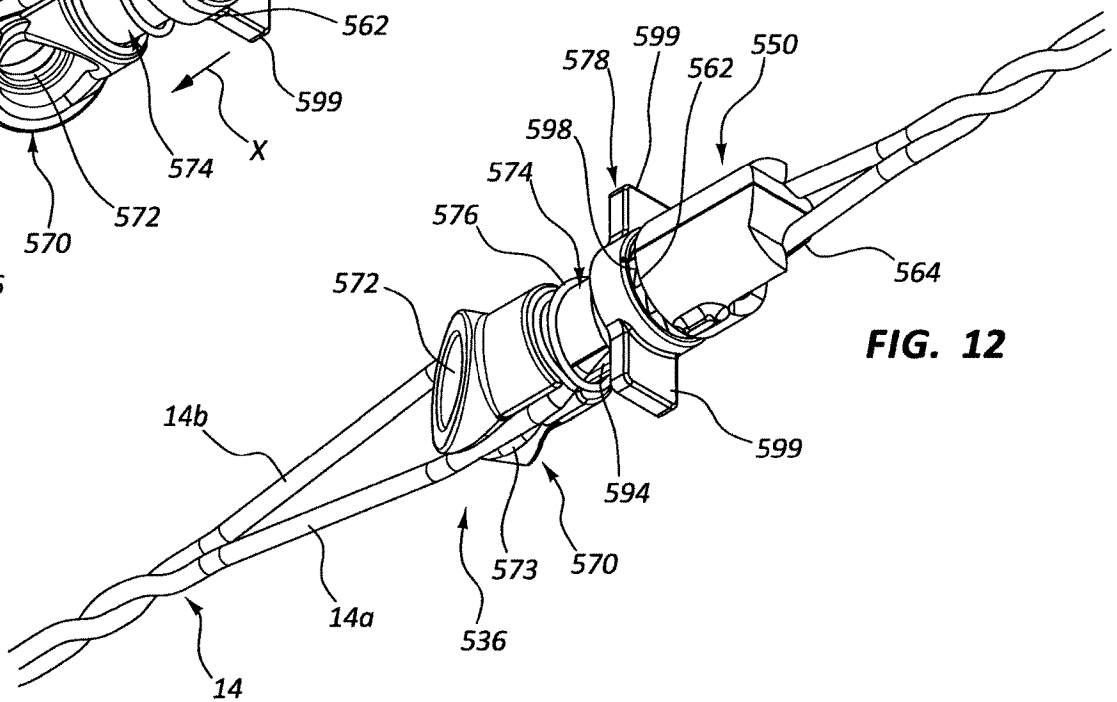
Figure 13:
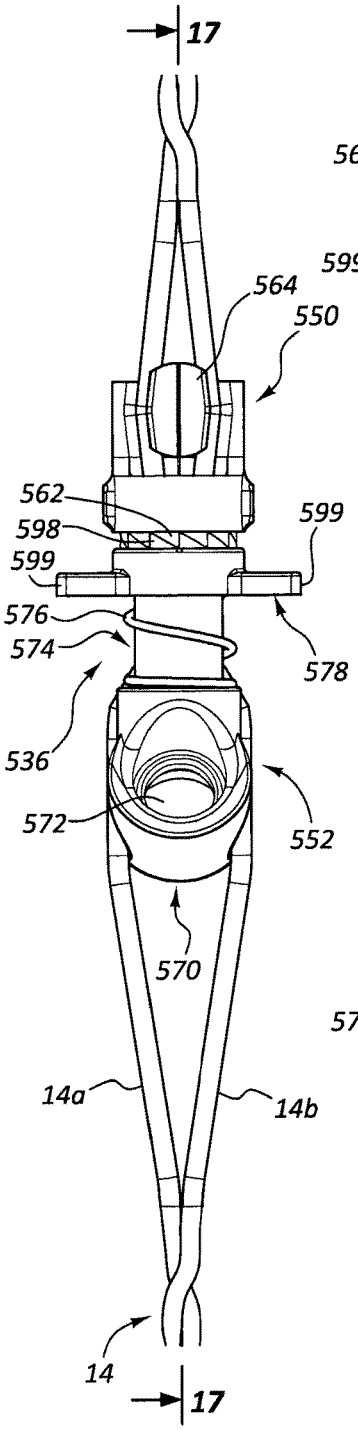
FIG. 13 is a front view of the bowstring adjuster of FIG. 11.
Figure 15:
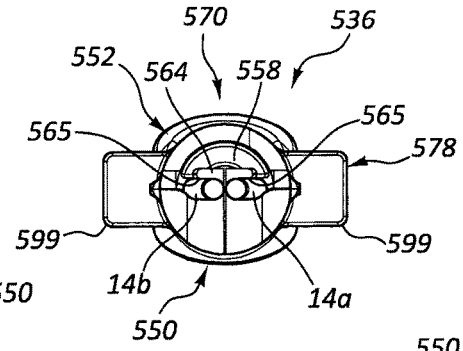
FIG. 15 is a top view of the bowstring adjuster of FIG. 11.
Figure 16:
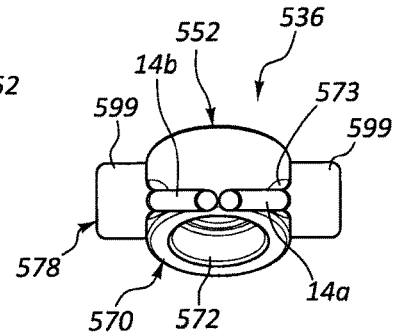
FIG. 16 is a bottom view of the bowstring adjuster of FIG. 11.
Figure 14:
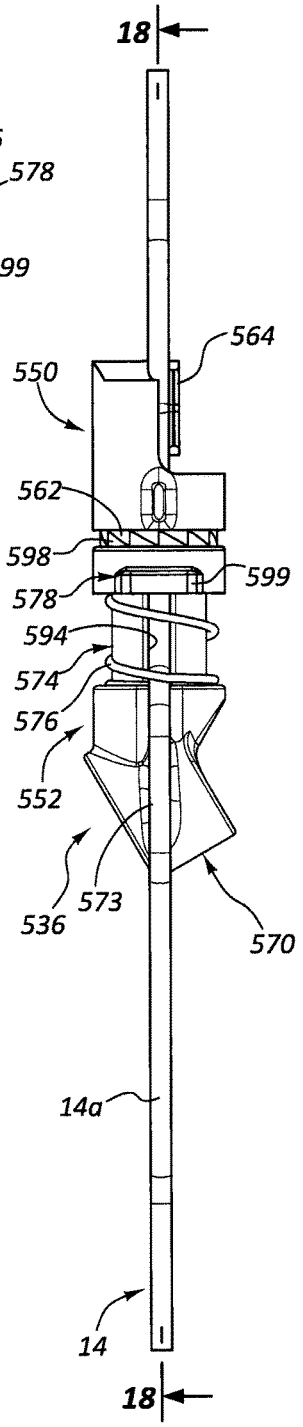
FIG. 14 is a side view of the bowstring adjuster of FIG. 11.

The bowstring adjuster 536 may be operable to alter a length of the bowstring 14 or to alter a rotated position of the peep sight portion 570 relative to the bowstring 14. The bowstring adjuster 536 may be operated by first applying an axially directed force to the gear member 578 in the direction X as shown in FIG. 11. Applying this force moves the teeth 598 away from the teeth 562 so that the first and second connection assemblies 550, 552 may rotate relative to each other. The user may apply a rotation force to the gear member 578 in the rotation direction R as shown in FIG. 11 to rotate the first and second connection assemblies 550, 552 relative to each other. After a desired rotational position is achieved, the user may release the gear member 578 such that the biasing member 576 moves the gear member 578 in an axial direction to re-engage the teeth 598, 562. The axial force applied by biasing member 576 maintains engagement between teeth 598, 562, which limits relative rotational movement between the first and second connection assemblies 550, 552 until an axially directed force is again applied to the gear member 578 in the direction X.

The bowstring adjuster 536 may be mounted to the bowstring 14 of an archery bow 10 as shown in FIGS. 19 and 20. The peep sight opening 572 of the peep sight portion 570 may be arranged at an angle $\alpha$ relative to the bowstring 14 as shown in FIG. 17. The central axis $A_1$ extending through the peep sight opening 572 may extend in at least a partially vertical direction (e.g., a direction in parallel with the portion of bowstring 14 to which the bowstring adjuster 536 is mounted) before the archery bow 10 is drawn, as shown in FIG. 19. When the archery bow 10 is in a fully drawn position (i.e., at full draw) as shown in FIG. 20, the axis $A_1$ may be aligned substantially parallel with an axis $A_2$, which represents a longitudinal axis of an arrow being launched by the archery bow 10. The orientation of central axis $A_1$ with the axis $A_2$ may align the peep sight portion 570 with features of the bow sight 32.

Integrating peep sight features into the bowstring adjuster 536 may simplify and provide improved control over adjustment of a rotated position of the peep sight relative to the bowstring 14 when operating the bowstring adjuster 536 to align the peep sight opening 572 with features of the bow sight 32.

Referring now to FIGS. 21-28, another example bowstring adjuster 636 is shown and described. The bowstring adjuster 636 includes first and second connection assemblies 650, 652. The bowstring adjuster 636 may have similarities to the bowstring adjuster 536 described above, such as the integration of peep sight features into one of the first and second connection assemblies 650, 652.

Figure 21:
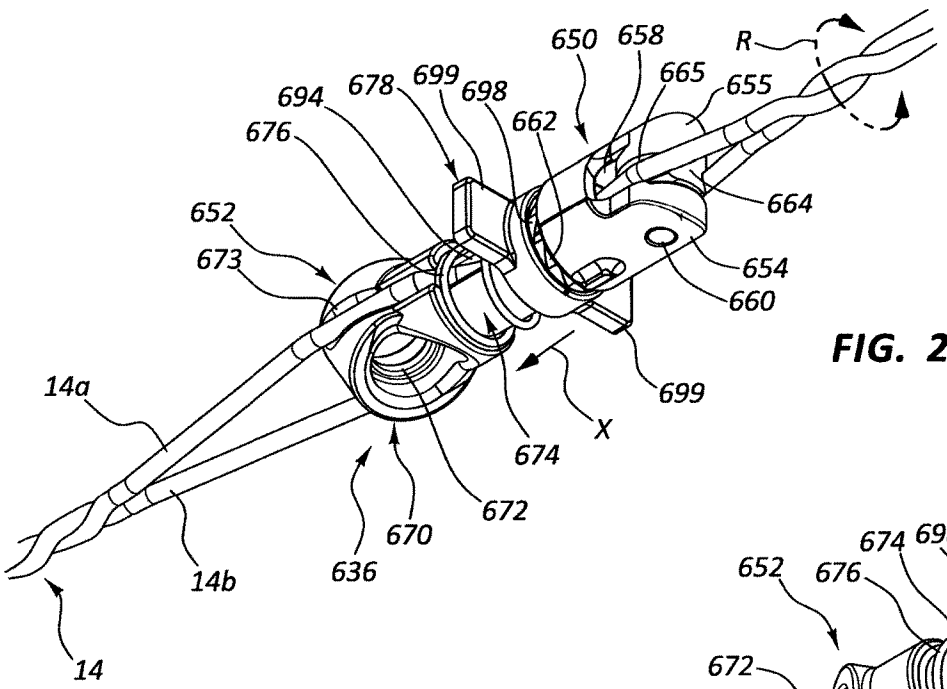
FIGS. 21 and 22 are perspective views of another example bowstring adjuster in accordance with the present disclosure.
Figure 22:
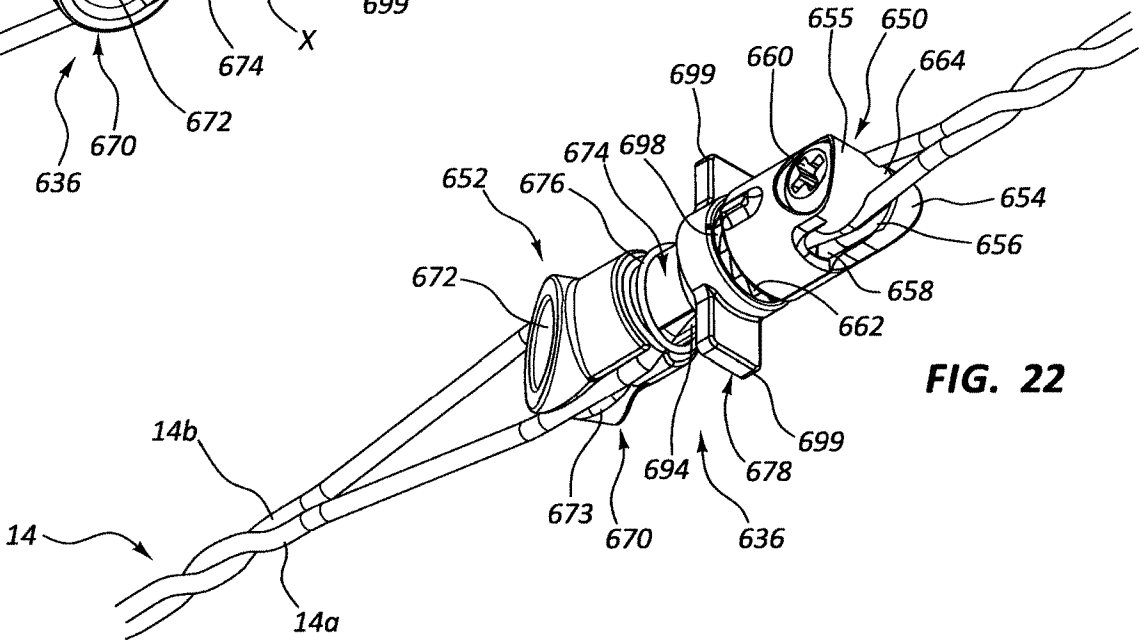
Figure 23:
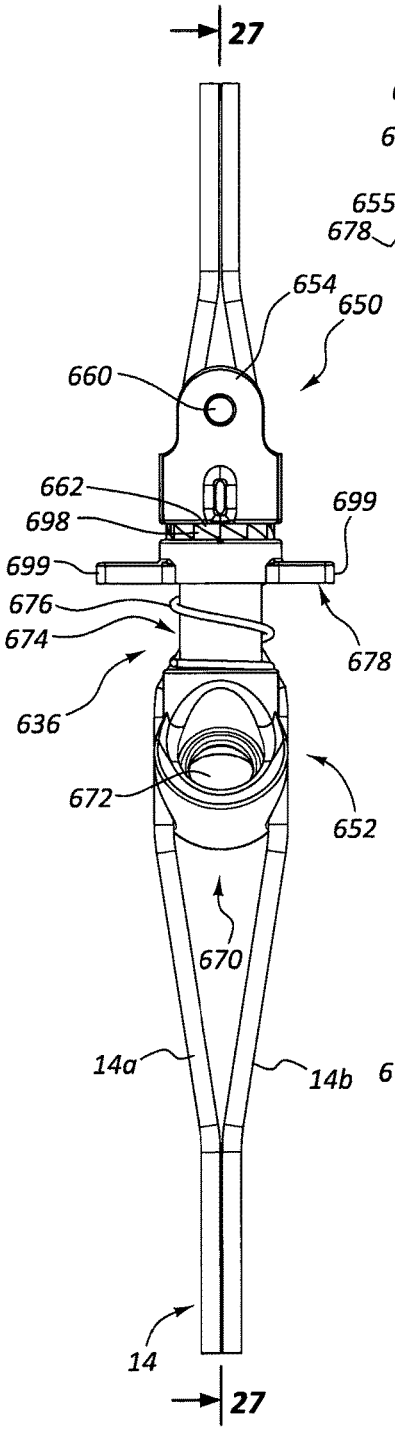
FIG. 23 is a front view of the bowstring adjuster of FIG. 21.
Figure 25:
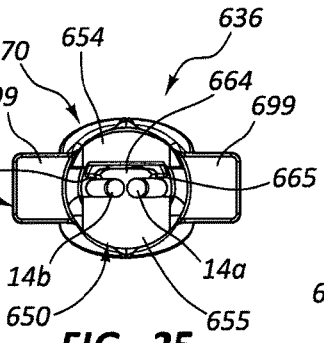
FIG. 25 is a top view of the bowstring adjuster of FIG. 21.
Figure 26:
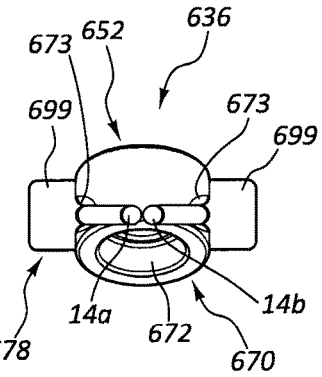
FIG. 26 is a bottom view of the bowstring adjuster of FIG. 21.
Figure 24:
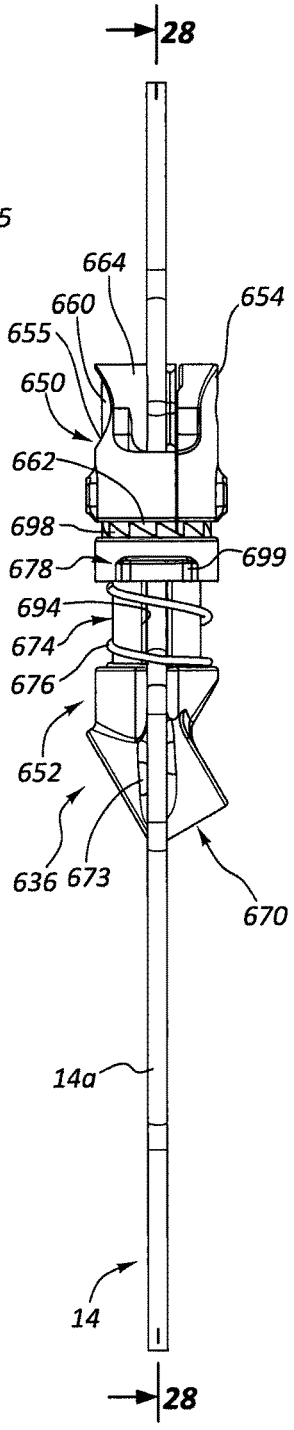
FIG. 24 is a side view of the bowstring adjuster of FIG. 21.

The first connection assembly 650 may include a bore 658, a plurality of teeth 662, a spacer 664, a seat or stop surface 666, first and second housing members 654, 655, and a fastener 660. At least one of the first and second housing members 654, 655 may define the spacer 664, which extends between the bowstring strands 14*a*, 14*b* as shown in FIGS. 21 and 22. The fastener 660 holds the first and second housing member 654, 655 together to capture the bowstring strands 14*a*, 14*b* within the first connection assembly 650. The first and second housing members 654, 655, when assembled together, may include a pair of grooves 665 on opposing sides of the spacer 664 (see FIGS. 21 and 22). The strands 14*a*, 14*b* may extend through the bore 658 and into the second connection assembly 652.

The first connection assembly 650 may be mounted to the bowstring 14 by removing the fastener 660, mounting the first and second housing member 654, 655 to the bowstring 14 with the spacer 664 positioned between the strands 14*a*, 14*b*, and reinserting the fastener 660 to provide a fixed assembly of the first connection assembly 650.

Figure 27:
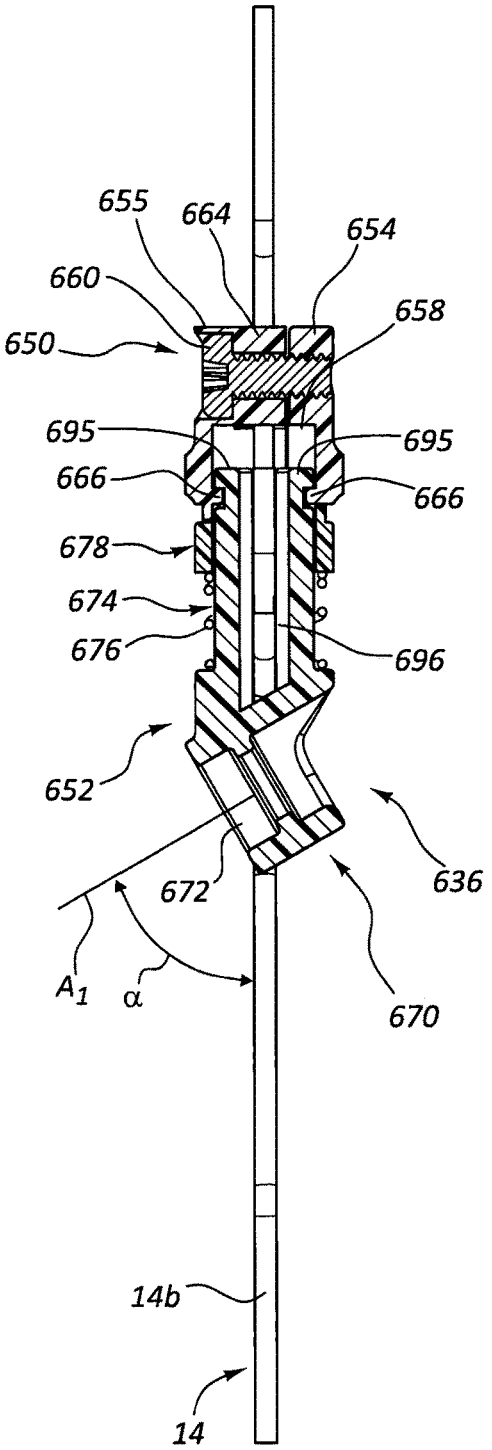
FIG. 27 is a cross-sectional view of the bowstring adjuster of FIG. 23 taken along cross-section indicators 27-27

The second connection assembly 652 may be separately mounted through the bowstring 14. The second connection assembly 652 includes a post portion 674 and a peep sight portion 670. The post portion 674 may include a slot 694, a connection portion 695, and a bore 696. The peep sight portion 670 may include a peep sight opening 672 having a central axis $A_1$ extending therethrough (see FIG. 27), and a pair of string grooves 673 extending along an exterior surface thereof. The central axis $A_1$ of the peep sight opening 672 may be arranged at an angle $\alpha$ relative to the bowstring 14 as shown in FIG. 27. The post portion 674 and peep sight portion 670 may be integrally formed as a single piece as shown in FIG. 27. In other examples, the post portion 674 and peep sight portion 670 may be formed as separate pieces that are assembled together.

The strands 14*a*, 14*b* may extend along an exterior of the peep sight portion 670 (e.g., through the string grooves 673), through the slots 694 and into the bore 696. The strands may also extend through the bore 658 of the first connection assembly 650. The peep sight portion 670 may perform a spacing function similar to the spacer 664 of the first connection assembly 650.

The gear member 678 may be used to fix a rotated position of the first connection assembly 650 relative to the second connection assembly 652. The gear member 678 may include at least one follower 697 (see FIG. 28), a plurality of teeth 698, and at least one handle 699. The gear member 678 may be biased towards the first connection assembly 650 with a biasing member 676. The bowstring adjuster 636 may be operated by applying an axially directed force to the gear member 678 in the direction X, as shown in FIG. 21. Application of the force in direction X disengages the teeth 698, 662 from each other. Thereafter, the user may apply a rotational force to the gear member 678 in the direction R to rotate the first connection assembly 650 relative to the second connection assembly 652. After a desired rotation position is achieved, the user may release the gear member 678 and the biasing member 676 applies an axial directed force to re-engage the teeth 698, 662.

Figure 28:
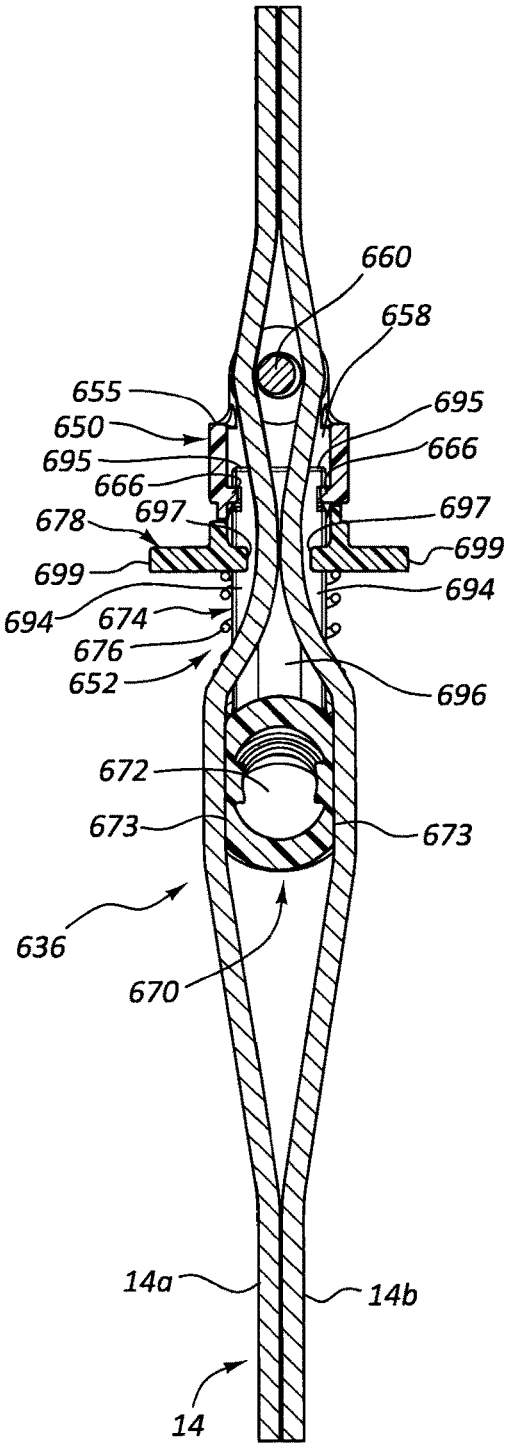
FIG. 28 is a cross-sectional view of the bowstring adjuster of FIG. 24 taken along cross-section indicators 28-28.

The first and second connection assemblies 650, 652 may be assembled together by inserting the post portion 674 through the bore 658 of the first connection assembly 650 as shown in FIGS. 27 and 28. The connection portion 695 may contact the seat 666 to retain the first and second connection assemblies 650, 652 assembled together. In at least one example, an end of the post portion 674 adjacent to the connection portion 695 may be insertable into the bore 658 until the connection portion 695 connects with the seat 666. The connection portion 695 may include a groove formed in an outer circumferential surface of the post portion 674. An interface between the connection portion 695 and the seat 666 may permit relative rotation between the first and second connection assemblies 650, 652 while limiting axial movement between the first and second connection assemblies 650, 652.

The structure of the first connection assembly 650 may provide an improved connection of the first connection assembly 650 to the bowstring 14. The first and second housing members 654, 655, when assembled together with fastener 660, may provide a positive connection to the strands 14*a*, 14*b* by capturing the strands 14*a*, 14*b* within the grooves 665. The first connection assembly 650 may also provide a releasable mounting of the first connection assembly 650 to the bowstring 14 and provide mounting of the first connection assembly 650 to the bowstring 14 after the bowstring is mounted to an archery bow.

The features of bowstring adjusters 536, 636, described with reference to FIGS. 11-28 may be integrated into any of the other bowstring adjuster embodiments described with reference to FIGS. 1-10. For example, the peep sight portion 570, 670 may be integrated into one of the first and second connection assemblies described with reference to FIGS. 1-10. Further, the integrated construction of features of the first connection assembly and the second connection assembly shown and described with reference to FIGS. 11-28 may be utilized in any of the embodiments of FIGS. 1-10.

It is to be understood that the present disclosure may be used in connection with and will provide benefits to any type of bowstring accessory. The features of bowstring adjusters will allow the bowstring accessory to be rotated, based upon a controlled, incremental adjustment of the bowstring adjusters 536, 636 such that the vertical position and rotational position of the bowstring accessory can be maintained in a constant orientation notwithstanding string stretch or other factors that affect the string. The benefits of the present disclosure may eliminate the need to clamp or serve the accessory onto the bowstring. Potential bowstring accessories that may benefit from the present disclosure include, for example and without limitation, nock sets or nocking point locations, speed weights, peep sights, D-loops, string silencers/dampeners, cable silencers/dampeners, kisser buttons, eliminator buttons, and drop-a-way rest anchors. As mentioned, the bowstring adjusters as described herein allow for rotational control as well as vertical location (i.e., axial location on the bowstring) control without the need to serve the bowstring accessory in place or clamp the bowstring accessory in place. In other words, relative rotation between the first and second portions of the bowstring adjusters (described above) will prevent the entire assembly from sliding or shifting during use, and will not negatively impact the durability of the string from, for example, clamping such accessories to the string.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms.

Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing figures. However, it is to be understood that the subject matter described herein may assume various alternative orientations and, accordingly, such terms are not to be considered as limiting. Furthermore, as used herein (i.e., in the claims and the specification), articles such as "the," "a," and "an" may connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An archery bow, comprising:

a riser having first and second ends;

first and second limbs extending from respective first and second ends of the riser;

a bowstring extending between the first and second limbs, the bowstring having a first strand and a second strand;

a bowstring adjuster comprising:

a longitudinal axis;

a first connector assembly connected to the bowstring at a first location, the first connector assembly comprising a first connector and a fastener, the first connector including a plurality of teeth, each of the first plurality of teeth having a first longitudinally-aligned surface parallel to the longitudinal axis, the fastener extending between the first and second strands along an axis oriented perpendicular to the longitudinal axis;

a second connector assembly connected to the bowstring at a second location spaced longitudinally from the first location along the longitudinal axis, the second connector assembly comprising a second connector and a gear biased toward the first connector, the gear including a second plurality of teeth, each of the second plurality of teeth having a second longitudinally-aligned surface parallel to the longitudinal axis, wherein the first and second connector assemblies are movable relative to each other between a first position and a second position, the second connector assembly being rotatable relative to the first connector assembly to adjust one of a rotation orientation and a length of the bowstring, wherein the first longitudinally-aligned surfaces of the first plurality of teeth of the first connector assembly and the second longitudinally-aligned surfaces of the second plurality of teeth of the second connector assembly circumferentially engage each other to limit relative rotation between the first and second connector assemblies, wherein the bowstring continuously extends across the bowstring adjuster.

2. The archery bow of claim 1, wherein the second connector assembly is rotatable relative to the first connector assembly to adjust a length of the bowstring between the first and second locations.

3. The archery bow of claim 1, wherein the first and second connector assemblies extend perpendicularly between the first and second strands at the first and second locations, respectively.

4. The archery bow of claim 1, wherein at least one of the first and second connector assemblies is configured to fix a rotated position of the first connector assembly relative to the second connector assembly.

5. The archery bow of claim 1, wherein the bowstring adjuster further comprises a biasing member configured to bias the gear axially toward the first connector.

6. The archery bow of claim 1, wherein the bowstring is inserted through a portion of the bowstring adjuster.

7. The archery bow of claim 1, further comprising a peep sight connected to the bowstring adjuster, the peep sight having a peep sight opening.

8. The archery bow of claim 7, wherein the peep sight is integrally formed with one of the first connector assembly and the second connector assembly of the bowstring adjuster.

9. An archery bow, comprising:

a riser having first and second ends;

first and second limbs extending from respective first and second ends of the riser;

a bowstring extending between the first and second limbs;

first and second pulleys carried by the first and second limbs, respectively;

first and second cables mounted to the first and second pulleys, respectively;

at least one cable adjuster connected to at least one of the first and second cables and comprising:

a longitudinal axis;

a first connector assembly connected to one of the first and second cables at a first location, the first connector assembly having a first connector and a spacer, the first connector including a first plurality of teeth extending axially away from the first connector assembly along the longitudinal axis, the spacer being positioned radially between at least two strands of the bowstring relative to the longitudinal axis;

a second connector assembly connected to the one of the first and second cables at a second location spaced longitudinally from the first location, the second connector assembly having a second connector and a gear biased toward the first connector, the gear including a second plurality of teeth extending axially away from the second connector assembly along the longitudinal axis, the second connector assembly being rotatable relative to the first connector assembly to adjust a length of the one of the first and second cables, wherein circumferential engagement between the first plurality of teeth and the second plurality of teeth limits relative rotation between the first and second connector assemblies, the one of the first and second cables continuously extending across the at least one cable adjuster.

10. The archery bow of claim 9, wherein at least one cable adjuster is connected to the first cable and an additional cable adjuster is connected to the second cable.

11. The archery bow of claim 9, wherein the first connector assembly includes a first connection member configured to be inserted through the one of the first and second cables at the first location, and the second connector assembly includes a second connection member configured to be inserted through the one of the first and second cables at the second location.

12. The archery bow of claim 9, wherein the at least one cable adjuster further comprises a biasing member configured to bias the gear toward the first connector assembly.

13. An archery bow system, comprising:

a bowstring or cable configured to mount to an archery bow, the bowstring having a longitudinal axis;

a first connector assembly configured to mount to the bowstring or cable, the first connector assembly comprising a first connector and a spacer, the first connector including a first gear portion having a first plurality of teeth having first axially-aligned surfaces parallel to the longitudinal axis, the bowstring or cable continuously extending across the first connector assembly, wherein the spacer is positioned radially between at least two strands of the bowstring or cable relative to the longitudinal axis;

a second connector assembly configured to mount to the bowstring or cable, the second connector assembly comprising a second gear portion having a second plurality of teeth, the second plurality of teeth having second axially-aligned surfaces parallel to the longitudinal axis, the bowstring or cable continuously extending across the second connector assembly, the first and second pluralities of teeth being biased toward each other;

wherein in a first position, the first axially-aligned surfaces of the first plurality of teeth of the first gear engage the second axially-aligned surfaces of the second plurality of teeth of the second gear in a circumferential direction and limit relative rotation between the first and second connector assemblies, and in a second position, the first plurality of teeth is releasable from engagement with the second plurality of teeth to allow the first connector assembly to rotate relative to the second connector assembly to adjust a length of the bowstring or cable.

14. The archery bow system of claim 13, wherein the first connector assembly is biased into contact with the second connector assembly to releasably fix a rotated position of the first connector assembly relative to the second connector assembly.

15. The archery bow system of claim 13, wherein a portion of the first connector assembly is configured to extend through the bowstring or cable at a first location, and a portion of the second connector assembly is configured to extend through the bowstring or cable at a second location.

16. The archery bow system of claim 15, wherein the first connector assembly is rotatable relative to the second connector assembly to adjust a length of the bowstring or cable between the first and second locations.

17. The archery bow system of claim 13, further comprising a peep sight connected to one of the first and second connector assemblies.

18. The archery bow system of claim 13, wherein one of the first and second connector assemblies comprises a peep sight having a peep sight opening.

19. A method of adjusting an archery bowstring, comprising:

providing an archery bow having a riser, first and second limbs extending from limb pockets of the riser, a bowstring extending between the first and second limbs, and a bowstring adjuster, the bowstring adjuster comprising at least first and second connector assemblies and a longitudinal axis, the first connector assembly comprising a first connector including a first gear portion having a first plurality of teeth and a fastener, the first plurality of teeth comprising a first plurality of longitudinally-aligned surfaces, the second connector assembly comprising a second gear portion including a second plurality of teeth, the second plurality of teeth comprising a second plurality of longitudinally-aligned surfaces, the bowstring continuously extending across the bowstring adjuster and laterally external to the fastener;

connecting the first connector assembly to the bowstring at a first location;

connecting the second connector assembly to the bowstring at a second location axially spaced from the first location, wherein the second plurality of longitudinally-aligned surfaces of the second plurality of teeth of the second connector assembly circumferentially engage the first plurality of longitudinally-aligned surfaces of the first plurality of teeth of the first connector assembly and the second connector assembly is rotationally fixed relative to the first connector assembly, wherein the first gear portion is biased into contact with the second gear portion;

moving the first plurality of teeth and the second plurality of teeth out of engagement with each other and rotating the first connector assembly relative to the second connector assembly to adjust one of a length of the bowstring and a rotation orientation of the bowstring.

20. The method of claim 19, wherein the archery bow further comprises a peep sight mounted to the bowstring, and rotating the first connector assembly relative to the second connector assembly adjusts a rotated position of the peep sight relative to the riser.

21. The method of claim 20, wherein the peep sight is directly connected to one of the first and second connector assemblies.

22. A method of adjusting an archery bow, comprising:

providing an archery bow having a riser, first and second limbs extending from limb pockets of the riser, at least one pulley mounted to at least one of the first and second limbs, a bowstring extending between the first and second limbs, at least one cable connected to the at least one pulley, and a cable adjuster, the cable adjuster comprising at least first and second connector assemblies and a longitudinal axis, the first connector assembly having a first gear portion;

connecting the first connector assembly to the at least one cable at a first location, wherein a spacer portion of the first connector assembly extends through the at least one cable at the first location;

connecting the second connector assembly to the at least one cable at a second location axially spaced from the first location along the longitudinal axis, the at least one cable having a length continuously extending across the cable adjuster;

rotating a second gear portion of the second connector assembly relative to the first gear portion of the first connector assembly to adjust a length of the at least one cable;

engaging a first plurality of teeth of the portion of the second connector assembly with a second plurality of teeth of the second connector assembly by the first plurality of teeth coming into contact with surfaces of the second plurality of teeth parallel to the longitudinal axis, the engagement of the first plurality of teeth and the second plurality of teeth limiting relative rotation of the first and second connector assemblies, wherein the first and second pluralities of teeth are biased into engagement with each other.

23. The method of claim 22, wherein the archery bow includes first and second cables connected to first and second pulleys, respectively, and first and second cable adjusters connected to the first and second cables, respectively.

24. The method of claim 22, wherein adjusting a length of the at least one cable adjusts timing of rotation of the at least one pulley when operating the archery bow to shoot an arrow.

25. An archery bowstring adjuster, comprising:

a first connector assembly configured to mount to a bowstring for an archery bow with the bowstring continuously extending through the first connector assembly, the first connector assembly comprising a first connector including a fastener portion and a first gear portion with a first plurality of teeth, wherein the fastener portion is configured to be positioned radially between at least two strands of the bowstring relative to a longitudinal axis of the first connector assembly;

a second connector assembly configured to mount to the bowstring with the bowstring continuously extending through the second connector assembly, the second connector assembly comprising a second gear portion having a second plurality of teeth;

a biasing member biasing the first and second gear portions together;

wherein in a first relative position the first plurality of teeth and the second plurality of teeth contact each other and are rotationally fixed relative to each other, and in a second relative position the first plurality of teeth are out of contact with the second plurality of teeth and are rotatable relative to the second connector assembly to adjust a length of the bowstring;

an archery accessory integrally formed with the second connector assembly secured to the bowstring wherein the first connector assembly and the second connector assembly are incrementally adjustable relative to each other to control relative rotation of the accessory on the bowstring and maintain a constant vertical position of the accessory on the bowstring without the need to otherwise secure the accessory to the bowstring.

* * * * *